US006328301B1

(12) United States Patent
Tsujii et al.

(10) Patent No.: US 6,328,301 B1
(45) **Date of Patent: *Dec. 11, 2001**

(54) SHEET SUPPLYING APPARATUS

(75) Inventors: Hiromichi Tsujii, Tokyo; Kiyoharu Yoshioka, Yokohama; Masao Amano, Kunitachi; Kazuhide Kudo, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/677,279

(22) Filed: Jul. 9, 1996

(30) Foreign Application Priority Data

Jul. 10, 1995 (JP) ..... 7-173451

(51) Int. Cl.[7] ..... B65H 3/06

(52) U.S. Cl. ..... 271/117; 271/160; 271/127; 271/126

(58) Field of Search ..... 271/117, 118, 271/119, 160, 127, 120, 122, 126

(56) References Cited

U.S. PATENT DOCUMENTS

| | | | | |
|---|---|---|---|---|
| 3,806,112 | * | 4/1974 | Melby et al. | 271/127 X |
| 3,883,132 | * | 5/1975 | Swanson | 271/110 |
| 3,919,972 | * | 11/1975 | Komori et al. | 271/118 |
| 4,032,136 | * | 6/1977 | Komaba et al. | 271/160 |
| 4,087,178 | * | 5/1978 | Pfeifer et al. | 271/117 |
| 4,219,192 | * | 8/1980 | Burke | 271/160 |
| 4,319,740 | * | 3/1982 | Ulseth | 271/119 X |
| 4,801,134 | * | 1/1989 | Yokoyama et al. | 271/122 |
| 4,925,177 | * | 5/1990 | Nakamura et al. | 271/110 |
| 5,029,838 | * | 7/1991 | Kunihiro | 271/117 |
| 5,193,797 | * | 3/1993 | Harada et al. | 271/118 |
| 5,228,671 | * | 7/1993 | Fish et al. | 271/9.09 |
| 5,235,381 | | 8/1993 | Namiki et al. . | |
| 5,252,854 | | 10/1993 | Tanoue et al. . | |
| 5,346,199 | * | 9/1994 | Martin et al. | 271/117 |
| 5,571,265 | * | 11/1996 | Yagi et al. | 271/119 |
| 5,615,873 | * | 4/1997 | Kobayashi et al. | 271/121 |
| 5,626,334 | * | 5/1997 | Kondo et al. | 271/121 |
| 5,632,477 | * | 5/1997 | Morinaga | 271/127 |
| 5,678,814 | * | 10/1997 | Yokoyama et al. | 271/9.05 |
| 5,961,113 | * | 10/1999 | Morris | 271/22 |

FOREIGN PATENT DOCUMENTS

| | | | | |
|---|---|---|---|---|
| 0 083 025 | | 12/1982 | (EP) . | |
| 57-98443 | * | 6/1982 | (JP) | 271/122 |
| 166236 | * | 10/1982 | (JP) | 271/117 |
| 61-114935 | * | 6/1986 | (JP) | 271/122 |
| 62-004147 | | 1/1987 | (JP) . | |
| 62-140944 | * | 6/1987 | (JP) | 271/127 |
| 48732 | * | 2/1989 | (JP) | 271/119 |
| 2-48341 | * | 2/1990 | (JP) | 271/122 |
| 101537 | * | 8/1990 | (JP) | 271/118 |
| 166141 | * | 7/1991 | (JP) | 271/119 |
| 4-66432 | * | 3/1992 | (JP) | 271/122 |
| 4-169449 | * | 6/1992 | (JP) | 271/122 |
| 4-223939 | * | 8/1992 | (JP) | 271/122 |
| 17033 | * | 1/1993 | (JP) | 271/118 |
| 301645 | * | 11/1993 | (JP) | 271/117 |

(List continued on next page.)

*Primary Examiner*—Christopher P. Ellis
*Assistant Examiner*—Richard Ridley
(74) *Attorney, Agent, or Firm*—Fitzpatrick, Cella, Harper & Scinto

(57) ABSTRACT

The present invention provides a sheet supplying apparatus comprising a sheet supporting means for supporting a sheet, a sheet supply means supported to contact with and separate from the sheet supported by the sheet supporting means and adapted to feed out the sheet by contacting with the sheet, a first biasing means for biasing the sheet supporting means toward the sheet supply means, and a second biasing means for biasing the sheet supply means toward the sheet supported by the sheet supporting means.

9 Claims, 23 Drawing Sheets

U.S. PATENT DOCUMENTS

| | | | | |
|---|---|---|---|---|
| 319594 | * | 12/1993 | (JP) | 271/117 |
| 6-1478 | * | 1/1994 | (JP) | 271/122 |
| 171771 | * | 6/1994 | (JP) | 271/117 |
| 6-171775 | * | 6/1994 | (JP) | 271/122 |
| 06247567 | | 9/1994 | (JP) . | |
| 62-47567 | | 9/1994 | (JP) . | |

* cited by examiner

SHEET SUPPLYING APPARATUS

BACKGROUND OF THE INVENTION

1. Field of the Invention

The present invention relates to a sheet supplying apparatus used with an image forming apparatus such as a printer, a copying machine, a facsimile and the like.

2. Related Background Art

An example of a conventional sheet supplying apparatus will be explained with reference to FIGS. 22 to 25. In FIG. 22, a sheet supplying cassette 106 contains a plurality of sheets S therein, and a sheet stacking plate 105 on which the sheets S are stacked is mounted within the sheet supply cassette 106 for pivotal rotation with respect to the cassette around a support shaft 105*a*.

Separation pawls 101 serve to regulate both downstream upper end corners of the sheet stack S so that an uppermost sheet S can be separated from the other sheets when a sheet supplying operation is started. A pick-up roller 103 is rotated around its own central shaft 103*a* in a direction shown by the arrow p to pick up the sheet S from the sheet supply cassette 106. The picked-up sheet S is conveyed into the interior of a body of an image forming apparatus (not shown).

An elastic member 102 serves to afford sheet supply pressure R to the pick-up roller 103. The elastic member 102 is disposed below the sheet stacking plate 105 and normally biases the sheet stack S and the sheet stacking plate 105 toward the pick-up roller 103 with a biasing force F shown in FIG. 23. In general, the sheet supply pressure R is defined by a force obtained by subtracting a gravity force of (a weight) of the sheet stack S from the biasing force F of the elastic member 102. This is the same in the following explanation.

As shown in FIG. 23, the pick-up roller 103 is constituted by a cylindrical surface portion and a flat surface portion so that it has a semi-circular (D-cut) cross-section. In an inoperative condition, the flat surface portion is directed downwardly to face the sheet stack S so that the flat surface portion is not contacted with an upper surface of the sheet stack S a height of which is regulated by the separation pawls 101.

In response to a sheet supply signal, when the pick-up roller 103 is rotated in the direction p in FIG. 23, as shown in FIG. 24, a forward end portion 103*b* of the cylindrical surface portion of the pick-up roller 103 is firstly contacted with the sheet stack S. In this case, the sheet stack S and the sheet stacking plate 112 are urged upwardly in opposition to the sheet supply pressure R (FIG. 24), with the result that the uppermost sheet S is displaced to form a loop portion Sa as shown in FIG. 24.

When the pick-up roller 103 is further rotated in the direction p (FIG. 24), as shown in FIG. 25, a tip end of the uppermost sheet S overrides the separation pawls 101, with the result that the uppermost sheet S alone is sent to the pair of convey rollers. The pick-up roller 103 is further rotated in the direction p. When the pick-up roller is rotated by one revolution, a condition shown in FIG. 23 is restored, with the result that the pick-up roller does not act on the sheet during further conveyance of the picked-up sheet S and is prepared for a next sheet supplying operation.

FIG. 26 shows a conventional electrophotographic image forming apparatus having the above-mentioned sheet supplying apparatus. In this image forming apparatus, a sheet supply cassette 202 is removably mounted within a body 201 of the image forming apparatus (the cassette can be dismounted from the apparatus along a direction shown by the arrow A), and there are disposed a sheet supply roller 203 for supplying a sheet S, a feed roller 204 and a retard roller 205 which are disposed at a downstream side of the sheet supply roller and which serve to separate and convey the sheet S.

The retard roller 205 is urged against the feed roller 204 by a biasing means (not shown) from below with a predetermined force F, and the feed roller 204 is drivingly rotated in a direction (for conveying the sheet S in a downstream side) shown by the arrow c by a drive means (not shown) provided within the body 201 of the image forming apparatus. Further, the retard roller 205 is connected to a drive shaft of the drive means (not shown) provided within the apparatus body 201 via a torque limiter, so that the retard roller is rotated in a direction (for conveying the sheet S in an upstream side) shown by the arrow d under the control of a torque action of the torque limiter.

Since the retard roller 205 is urged against the feed roller 204, when a rotational driving force of the feed roller 204 (directing toward the direction c) acts on the retard roller 205 to apply predetermined torque acting toward a direction e (opposite to the direction d) to the retard roller 205, slip is generated in the torque limiter, with the result that the retard roller 205 is driven by the rotation of the feed roller 204 to rotate in the direction e. That is to say, although the retard roller 205 is rotated in the direction d to return the sheet S within the predetermined torque, when torque greater than the predetermined torque acts in the sheet conveying direction (direction e), the retard roller is rotated to convey the sheet S in the downstream direction. The torque at which the rotational direction of the retard roller is changed in this way is referred to as "return torque" (Ta) of the retard roller hereinafter. In this way, the sheets S are separated one by one between the feed roller 204 and the retard roller 205, and the separated sheet is conveyed in the downstream direction.

However, in the above-mentioned conventional technique, in case of the pick-up roller 103 shown in FIGS. 22 to 25, since sheets S having various sizes and/or weights are generally used, the sheet supply pressure R is not normally uniform or constant. That is to say, due to the gravity force acting on the sheets S, when light sheets S having small size are used, the biasing force F is increased to thereby increase the sheet supply pressure R; whereas, when heavy sheets S having large size are used, the biasing force F is decreased to thereby decrease the sheet supply pressure R.

Although the pick-up roller 103 serves to pick up the uppermost sheet S alone, if the sheet supply pressure R is too great, several sheets S including the uppermost sheet will be picked up by the pick-up roller (double-feed), whereas, if the sheet supply pressure R is too small, the pick-up roller 103 will be idly rotated on the sheet stack S not to supply any sheet. That is to say, both if the sheet supply pressure R is too great and is too small, the poor sheet supply will occur. In order to avoid this, it is necessary to maintain the sheet supply pressure R within a proper range.

However, as mentioned above, since various kinds of sheets are used, some sheets do not accommodate with the proper sheet supply pressure R set in the sheet supplying apparatus, thereby causing the poor sheet supply. Thus, it is necessary that an adjusting mechanism for increasing and decreasing the biasing force of the elastic member 102.

SUMMARY OF THE INVENTION

An object of the present invention is to provide a sheet supplying apparatus in which optimum sheet supply pressure can be obtained in accordance with a sheet size and/or a sheet weight.

To achieve the above object, according to the present invention, a sheet supplying apparatus comprises a sheet supporting means for supporting a sheet, a sheet supply means supported to contact with and separate from the sheet supported by the sheet supporting means to feed out the sheet by contacting with the sheet, a first biasing means for biasing the sheet supporting means toward the sheet supply means, and a second biasing means for biasing the sheet supply means toward the sheet supported by the sheet supporting means.

DETAILED DESCRIPTION OF PREFERRED EMBODIMENTS

The present invention will now be fully explained in connection with embodiments (sheet supplying apparatus and image forming apparatus having such a sheet supplying apparatus) with reference to the accompanying drawings.

First of all, a first embodiment of a pick-up portion of a sheet supplying apparatus according to the present invention will be described. In FIGS. 1 to 7, within a sheet supply cassette 6 for containing sheets S, there is provided a sheet stacking plate (sheet stacking means) 5 supported for pivotal movement around a pivot shaft (not shown) with respect to the sheet supply cassette 6 and adapted to support a sheet stack S. A coil spring 2 as an elastic member (first biasing means) is disposed between a lower surface of the sheet stacking plate 5 and a bottom of the sheet supply cassette 6.

Figure 1:
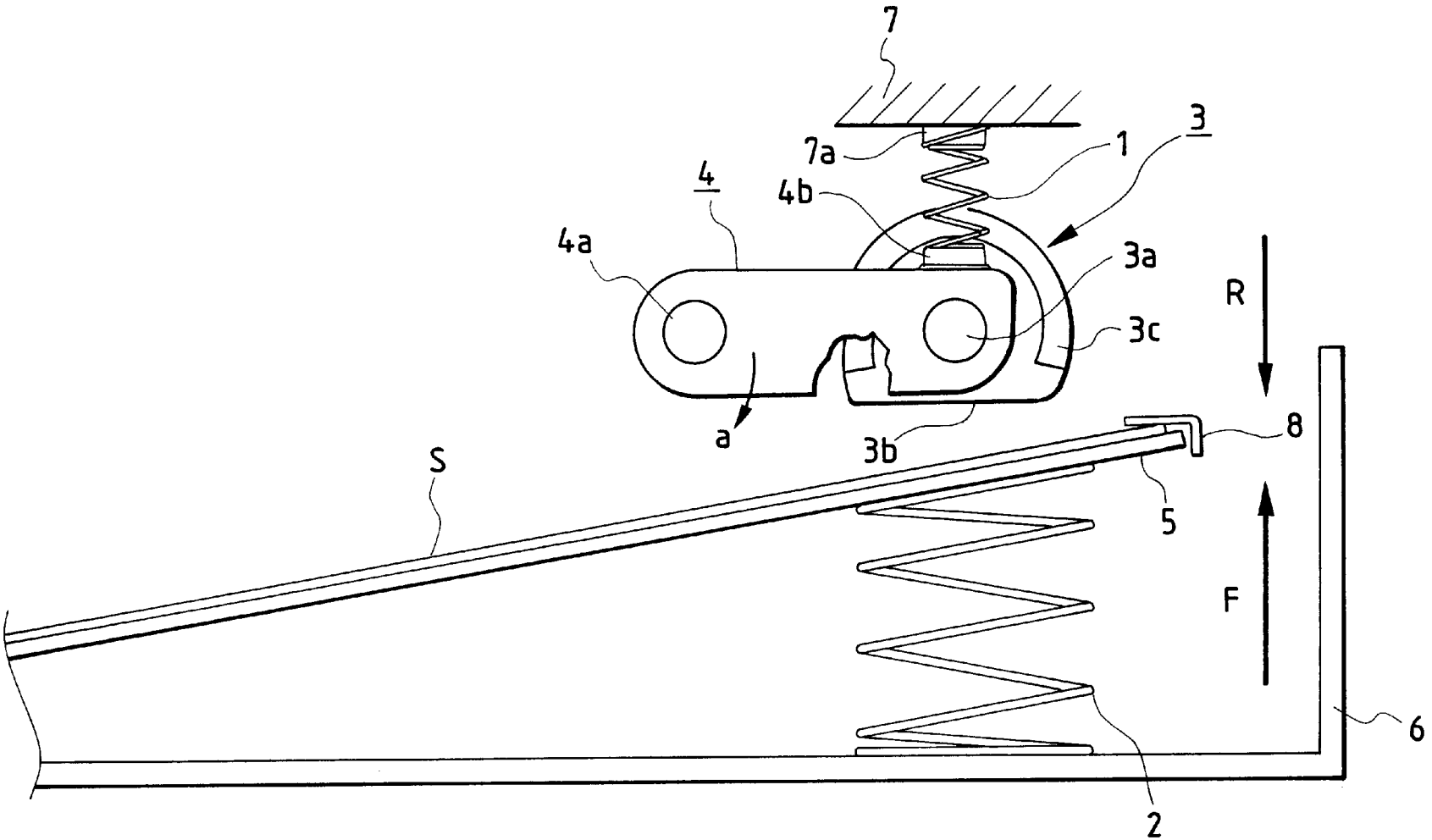
FIG. 1 is a sectional view showing a first embodiment of a pick-up portion of a sheet supplying apparatus according to the present invention.

In FIG. 1, the sheet stacking plate 5 is biased by a biasing force F of the coil spring 2 toward a direction shown by the arrow F, and separation pawls 8 provided within the sheet supply cassette 6 are engaged by the sheet stacking plate 5 or the sheet stack S rested on the sheet stacking plate 5, thereby regulating a height of the sheet stacking plate 5.

Pick arms 4 serve to act as a support means for rotatably supporting a pick-up roller 3. Each pick arm has one end pivotally connected to a frame 7 of the apparatus via a support shaft 4*a*. Further, when the pick arms 4 are rotated around the support shaft 4*a* by a predetermined angle, they are engaged by stoppers (not shown) provided on the frame 7, thereby regulating upward and downward pivotal movements of the pick arms.

The pick arms 4 have the other ends by which the pick-up roller (sheet supply means) 3 is supported via a shaft 3*a*. The pick-up roller 3 have a cylindrical surface portion constituted by a friction material 3*c*, and a flat surface portion 3*b* supporting the friction material 3*c* and defining a cutout which is not contacted with the sheet S. The pick-up roller 3 is driven and controlled by a drive system (not shown).

Projection portions 4*b* are formed on the respective pick arms 4 immediately above the shaft 3*a* for supporting the pick-up roller 3. Coil springs 1 as elastic members (second biasing means) for biasing the pick-up roller 3 and the pick arms 4 toward a direction shown by the arrow R in FIG. 4 have one ends fitted on and secured to the respective projection portions 4*b*. The other ends of the coil springs 1 are fitted on and secured to projection portions 7*a* provided on the frame 7. The coil springs 1, 2 are set so that, when the friction material 3*c* of the cylindrical surface portion of the pick-up roller 3 is contacted with the upper surface of the sheet stack S rested on the sheet stacking plate 5, the biasing force of the coil springs are balanced with each other to afford predetermined sheet supply pressure R to the sheet S.

Further, as shown in FIG. 1, when the flat surface portion 3*b* of the pick-up roller 3 is oriented downwardly to face the sheet S, the pick-up roller 3 does not contact with the sheet stack S rested on the sheet stacking plate 5.

Figure 2:
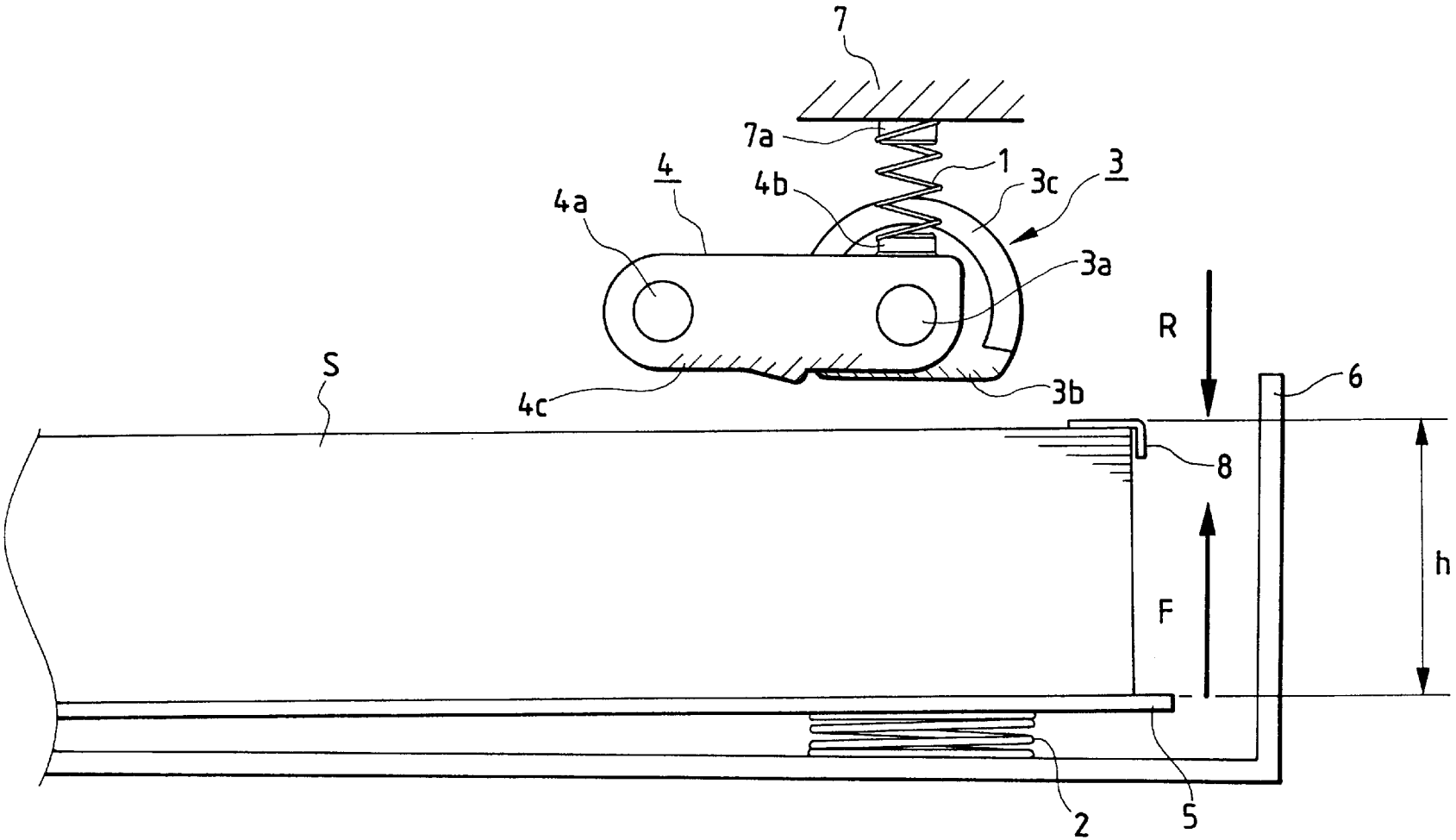
FIG. 2 is a sectional view of the pick-up portion of FIG. 1 showing a condition that standard sheets are stacked.

FIG. 2 shows a condition that sheets S having a standard weight are fully stacked on the sheet stacking plate 5 (stack height "h"). In this ideal condition, the weight of the sheet stack S rested on the sheet stacking plate 5 is balanced with the biasing force F oriented to the direction F, so that the biasing force F acting in the condition that no sheet S is rested on the sheet stacking plate as shown in FIG. 1 becomes equal to the biasing force F acting in the condition that the sheets S are fully stacked on the sheet stacking plate as shown in FIG. 2.

However, if sheets S having weight/size other than the standard one are stacked on the sheet stacking plate 5, the ideal biasing force of the coil spring 2 cannot be achieved, and, thus, dispersion of the biasing force will occur. Accordingly, even when the same amounts of sheets are stacked (for example, stacking height is h), the sheet supply pressure R of the pick-up roller 3 for the relatively light sheets will differ from the sheet supply pressure R for the relatively heavy sheets.

Figure 8:
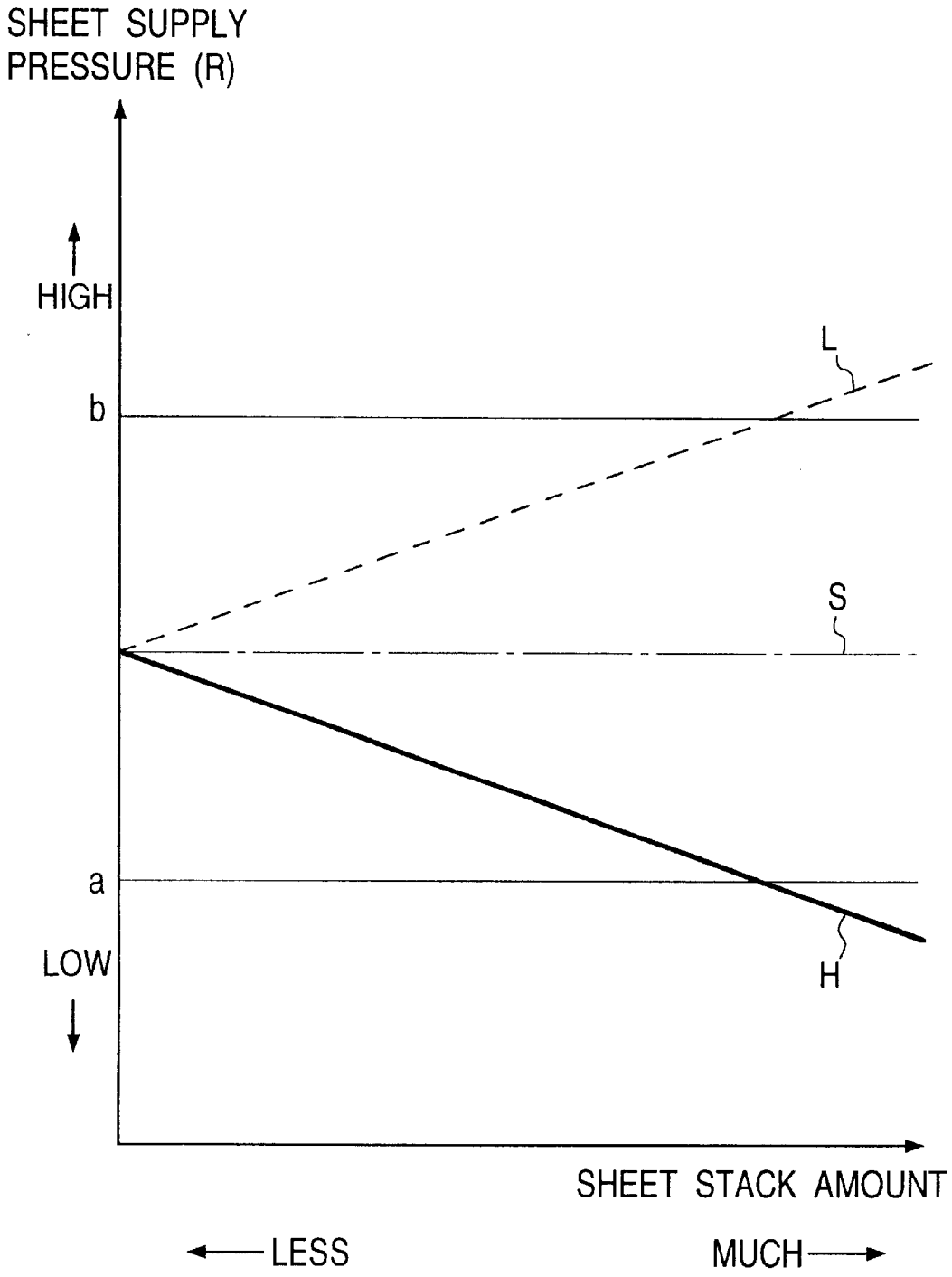
FIG. 8 is a graph showing a relation between various sheets and sheet supply pressure (R)

This relation will now be explained with reference to a graph shown in FIG. 8. In FIG. 8, the abscissa indicates a sheet stack amount, and the ordinate indicates the sheet supply pressure R of the pick-up roller 3 acting on the sheet S. In case of the sheet S having the standard weight shown by the dot and chain line S in FIG. 8, the sheet supply pressure R is substantially constant (ideal) from less stack amount to much stack and is contained within a proper range (minimum a, maximum b) in which the normal sheet supplying operation can be effected. Thus, in this case, the sheet S can be properly supplied.

In case of the sheet S having the relatively light weight shown by the broken line L in FIG. 8, the biasing force F of the coil spring 2 is increased (to increase the sheet supply pressure R) as the sheet stack amount is increased. In this case, if the sheet supply pressure R exceeds the maximum level b, the sheet supply pressure R will become too high, thereby causing the double-feed of sheets. On the other hand, in case of the sheet S having the relatively heavy weight shown by the solid line H in FIG. 8, the biasing force F of the coil spring 2 is decreased (to decrease the sheet supply pressure R) as the sheet stack amount is increased. In this case, if the sheet supply pressure R is lowered below the minimum level a, the sheet supply pressure R will become too low, thereby causing the poor sheet supply.

Figure 3:
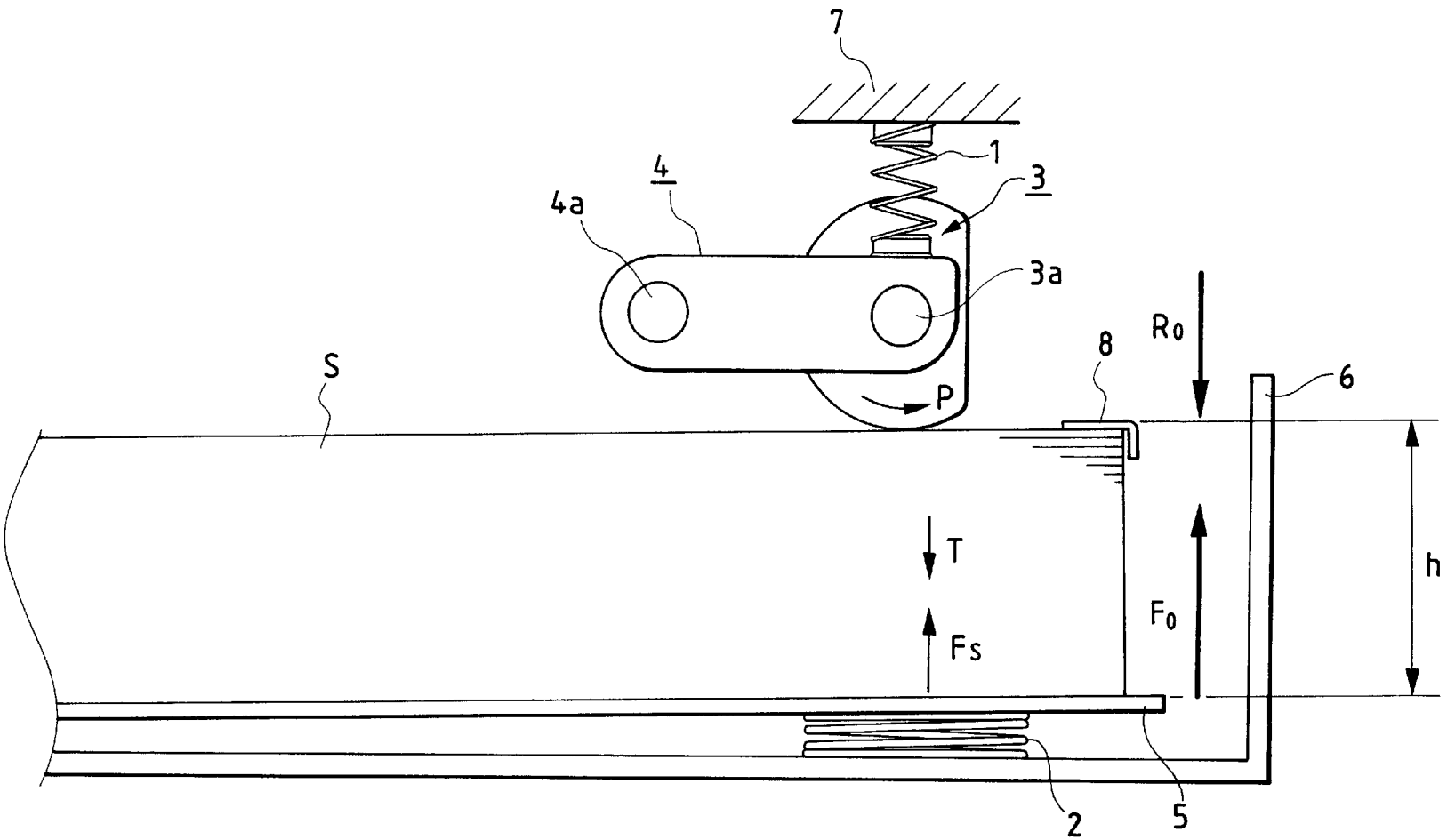
FIG. 3 is a sectional view of the pick-up portion of FIG. 1 showing a condition that the standard sheet is picked up.

In FIG. 2, when the sheets S having the standard weight are fully stacked on the sheet stacking plate 5 (stacking height h) and the pick-up roller 3 is rotated in the direction p in FIG. 3 to achieve the condition shown in FIG. 3, the pick-up roller 3 is contacted with the uppermost sheet of the sheet stack S. In this condition, the biasing forces of the coil springs 1, 2 and the gravity force are balanced. When the biasing force acting on the sheet stacking plate 5 from the coil spring 2 in Fs, the gravity force of the weight of the sheet stack S is T, the upward biasing force acting on the sheet stack due to the biasing force Fs of the coil spring 2 is Fo and the sheet supply pressure of the pick-up roller 3 acting on the sheet S is Ro, the following equation (1) is established:

$$Fo=Fs-T=Ro \tag{1}$$

That is to say, in case of the sheet S having the standard weight, since the coil spring 2 can provide the ideal biasing force (i.e., the biasing force of the coil spring 2 can act within a range represented by the product of "displacement" and "elastic modulus"), the upward biasing force Fo acting on the sheet stack S becomes equal to the sheet supply pressure Ro, with the result that the sheet S is picked up in the ideal condition. In case of the sheet S having the standard weight, even when the pick-up roller is of fixed type as is in the aforementioned conventional technique, the above equation (1) is established.

Figure 4:
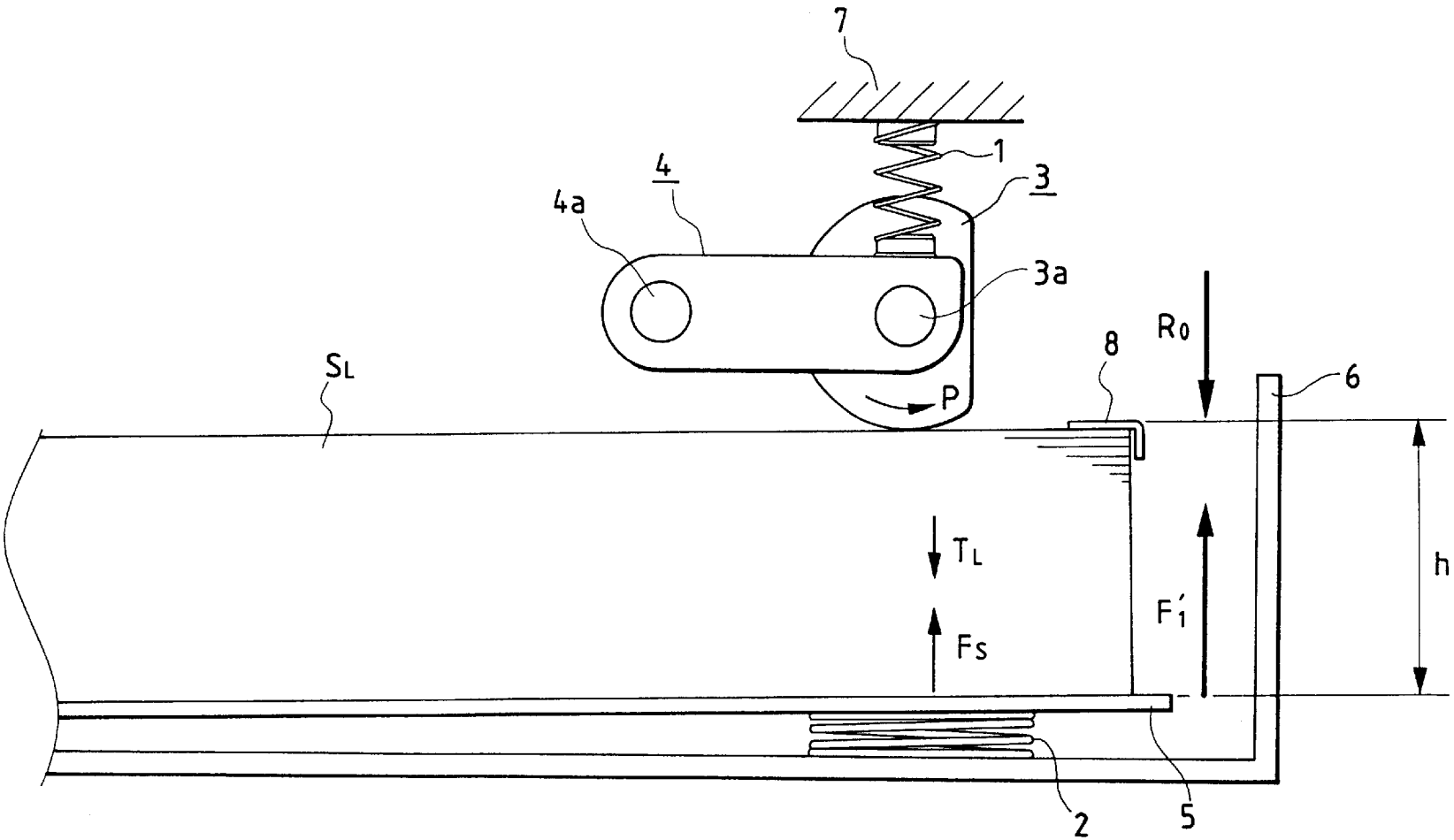
FIG. 4 is a sectional view of the pick-up portion of FIG. 1 showing a starting condition that a relatively light sheet is picked up.

Next, the case where the sheets S having the relatively light weight (in place of the sheets having the standard weight) are fully stacked on the sheet stacking plate 5 (stack height h) will be explained with reference to FIGS. 4 and 5. FIG. 4 shows a condition that the sheets S having the relatively light weight are fully stacked on the sheet stacking plate 5, corresponding to the condition shown in FIG. 3. In this condition, the biasing force acting on the sheet stacking plate 5 from the coil spring 2 is Fs as is in the aforementioned case. When the gravity force of the weight of the sheet stack S comprised of the sheets having the relatively light weight is $T_L$, an upward biasing force $F_1'$ acting on the sheet stack S becomes as follows:

$$F_1'=(Fs-T_L)>Ro \tag{2}$$

In the above-mentioned conventional arrangement, the upward biasing force $F_1'$ causes the increase in the sheet supply pressure R. To the contrary, in the illustrated embodiment, since the upward biasing force $F_1'$ is greater than the downward biasing force Ro of the coil springs 1, as shown in FIG. 5, the sheet stacking plate 5 is balanced at a position higher than the position shown in FIG. 4 by a predetermined distance, and the biasing force Fs of the coil spring 2 is decreased accordingly.

Figure 5:
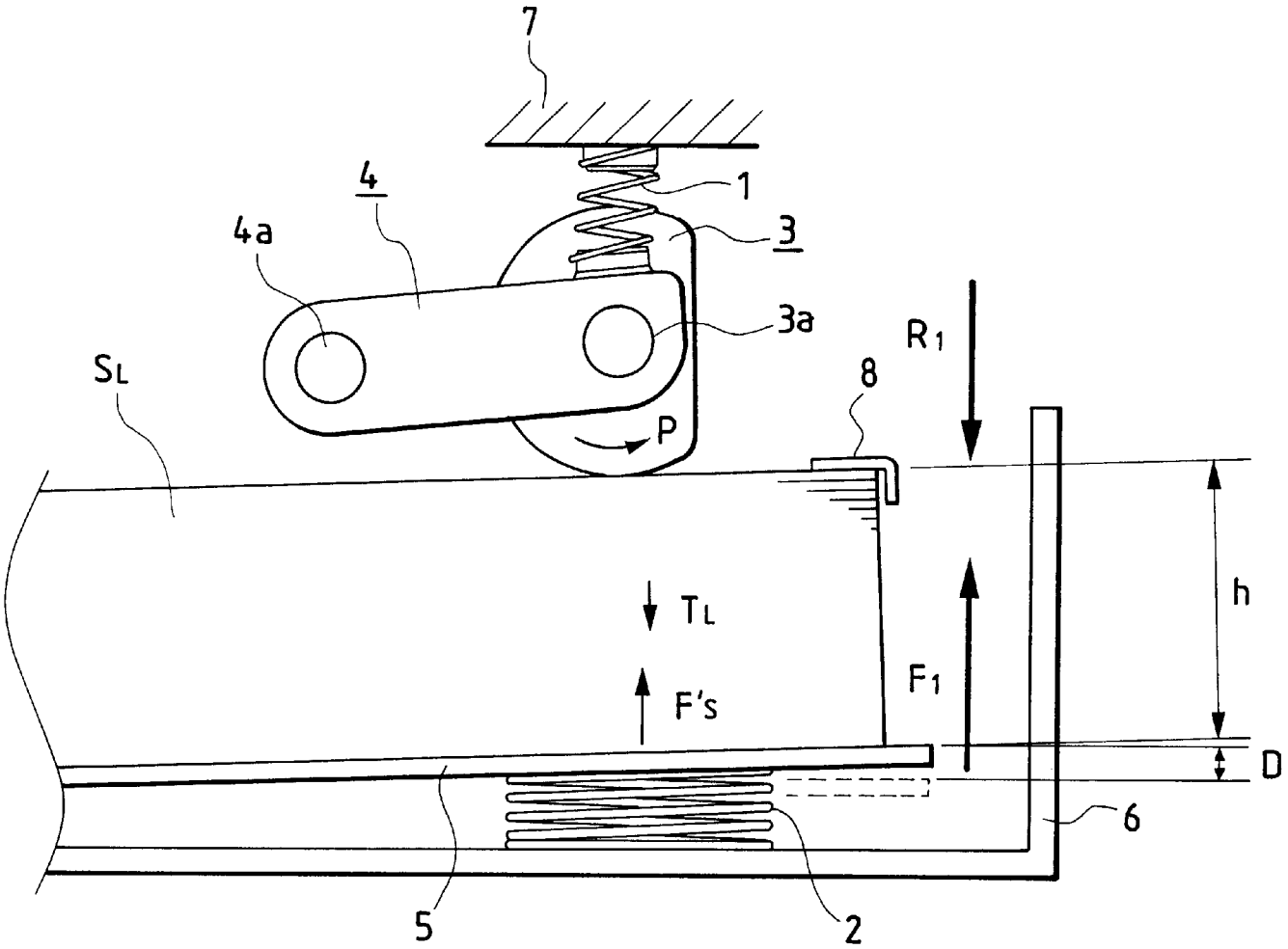
FIG. 5 is a sectional view of the pick-up portion of FIG. 1 showing an equilibrium condition when the relatively light sheet is picked up.

In FIG. 5, when a biasing force acting on the sheet stacking plate 5 from the coil spring 2 is Fs', the gravity force of the weight of the sheet stack S comprised of the sheets having the relatively light weight is $T_L'$ an upward biasing force acting on the sheet stack S is $F_1$ and the sheet supply force of the pick-up roller 3 acting on the sheet S is $R_1$, the following equation (3) is established:

$$F_1=Fs'-T_L=R_1 \tag{3}$$

When the difference in gravity force between the sheet stack S comprised of the sheets having the standard weight and the sheet stack S comprised of the sheets having the relatively light weight is $\{T-T_L(>0)\}$, the displacement (different in position) of the sheet stacking plate 5 is D and the spring constants of the coil springs 1, 2 are $k_0$, the following relations (4) and (5) can be obtained by referring to FIGS. 4 and 5.

First of all, regarding a relation between the upward biasing forces $F_1'$ and $F_1$ acting on the sheet stack S:

$$F_1'=F_1+k_0\times D,$$

in consideration of the above equation (2):

$$(Fs-T_L)-k_0\times D=F_1 \tag{4}$$

regarding a relation between the sheet supply pressures $R_0$ and $R_1$ due to the biasing force of the coil springs 1:

$$R_0+k_0\times D=R_1=F_1 \tag{5}$$

Accordingly, from the above equations (4) and (5), the values (distance) D becomes as follows:

$$D=(\tfrac{1}{2}k_0)\times\{(Fs-T_L)-R_0\} \tag{6}$$

From the above equation (6), the displacement (shift amount) D of the sheet stacking plate 5 can be obtained, and, by adding the equation (6) to the equation (4), the following equation (7) is established:

$$F_1=(Fs-T_L)-\tfrac{1}{2}\times\{(Fs-T_L)-R_0\} \tag{7}$$

since $Fs-T_L=F_1'$, $$F_1=F_1'-\tfrac{1}{2}\times(F_1'-R_0) \quad (8)$$

In the above equation (8), the value $F_1$ is the upward biasing force acting on the sheet stack S comprised of the sheets having the relatively light weight and the value $F_1$ is the upward biasing force acting on the sheet stack S comprised of the sheets having the standard weight. And, in the equation (8), the second item in the right side of the equation (8) indicates the difference between the downward biasing force of the coil springs 1 and the upward biasing force of the coil spring 2. Further, the second item in the right side of the equation (8) has a "positive" or "plus" value in consideration of the equation (2). Thus, $F_1$ is smaller than $F_1'$ ($F_1<F_1'$).

Therefore, with the arrangement according to the illustrated embodiment, the upward biasing force $F_1$ acting on the sheet stack S comprised of the sheets having the relatively light weight is decreased below the upward biasing force $F_1'$ acting on the sheet stack S comprised of the sheets having the standard weight (as is in the above-mentioned conventional technique), and, thus, the sheet supply pressure $R_1$ for the sheet S having the relatively light weight is decreased below the sheet supply pressure $R_0$ for the sheet S having the standard weight (as is in the above-mentioned conventional technique). That is to say, with the arrangement according to the illustrated embodiment, not that the change in the weight of the sheet stack S rested on the sheet stacking plate 5 directly affects an influence upon the change in the sheet supply pressure R, but that the sheet supply pressure is decreased in accordance with the change in the weight.

In the above explanation, while an example that the spring constants of the coil springs 1, 2 are the same ($k_0$) for simplicity's sake was explained, in general, the spring constant of the coil springs 1 differs from that of the coil spring 2. For example, when the spring constant of the coil springs 1 is k and the spring constant of the coil spring 2 is n×k (n>0; n is an actual number), the above-mentioned equations (4) and (5) are represented by the following equations (9) and (10), respectively:

$$(Fs-T_L)-n\times k\times D=F_1 \quad (9)$$

$$R_0+k\times D=R_1=F_1 \quad (10)$$

Accordingly, from the above equations (9) and (10), the value D can be determined as follows:

$$D=\{1/((n+1)\times k)\}\times\{(Fs-T_L)-R_0\} \quad (11)$$

By adding the equation (11) to the equation (9), the following equation is obtained:

$$F_1=(Fs-T_L)-n/(n+1)\times\{(Fs-T_L)-R_0\} \quad (12)$$

since $Fs-T_L=F_1'$, $$F_1=F_1-n/(n+1)\times(F_1'-R_0) \quad (13)$$

Now, since n>0, $$n/(n+1)>0 \quad (14)$$

Further, since $(F_1'-R_0)>0$, in consideration of the above equations (13) and (14), as is in the above case, a relation ($F_1<F_1'$) is obtained, and, thus, the change in weight of the sheet stack S can be relieved.

Figure 6:
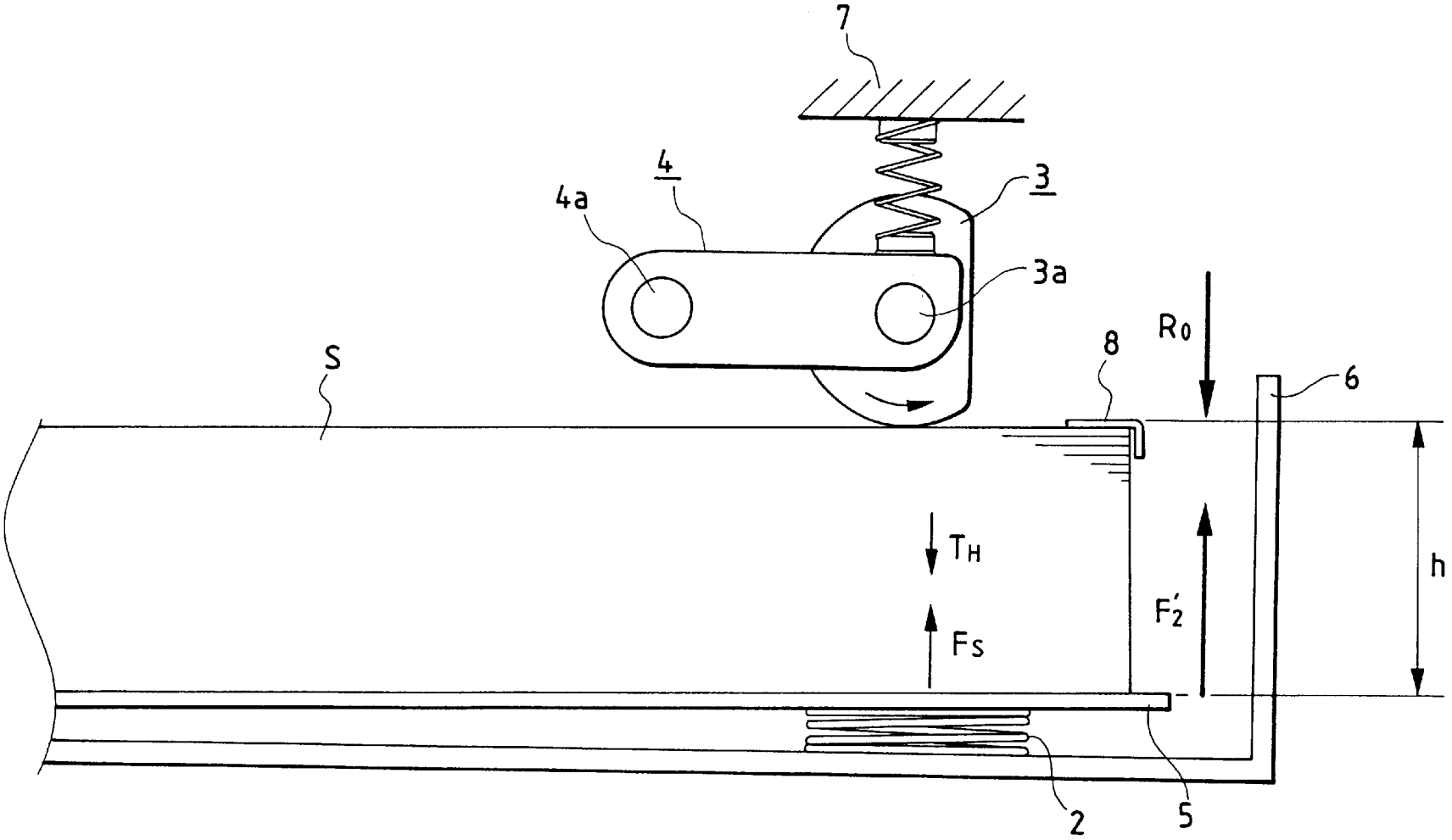
FIG. 6 is a sectional view of the pick-up portion of FIG. 1 showing a starting condition that a relatively heavy sheet is picked up.

Next, the case where the sheets S having the relatively heavy weight (in place of the sheets having the standard weight) are fully stacked on the sheet stacking plate 5 (stack height h) will be explained. When the sheets having the relatively heavy weight are stacked on the sheet stacking plate 5 in a condition as is in the condition shown in FIG. 3, the biasing force acting on the sheet stacking plate 5 from the coil spring 2 is Fs, as shown in FIG. 6. When the gravity force of the weight of the sheet stack S comprised of the sheets having the relatively heavy weight is $T_H$, an upward biasing force acting on the sheet stack S is $F_2'$ and the sheet supply pressure of the pick-up roller 3 contacted with the sheet having the relatively heavy weight is $R_0$, the following relation (15) is established:

$$F_2'=(Fs-T_H)<R_0 \quad (15)$$

Figure 7:
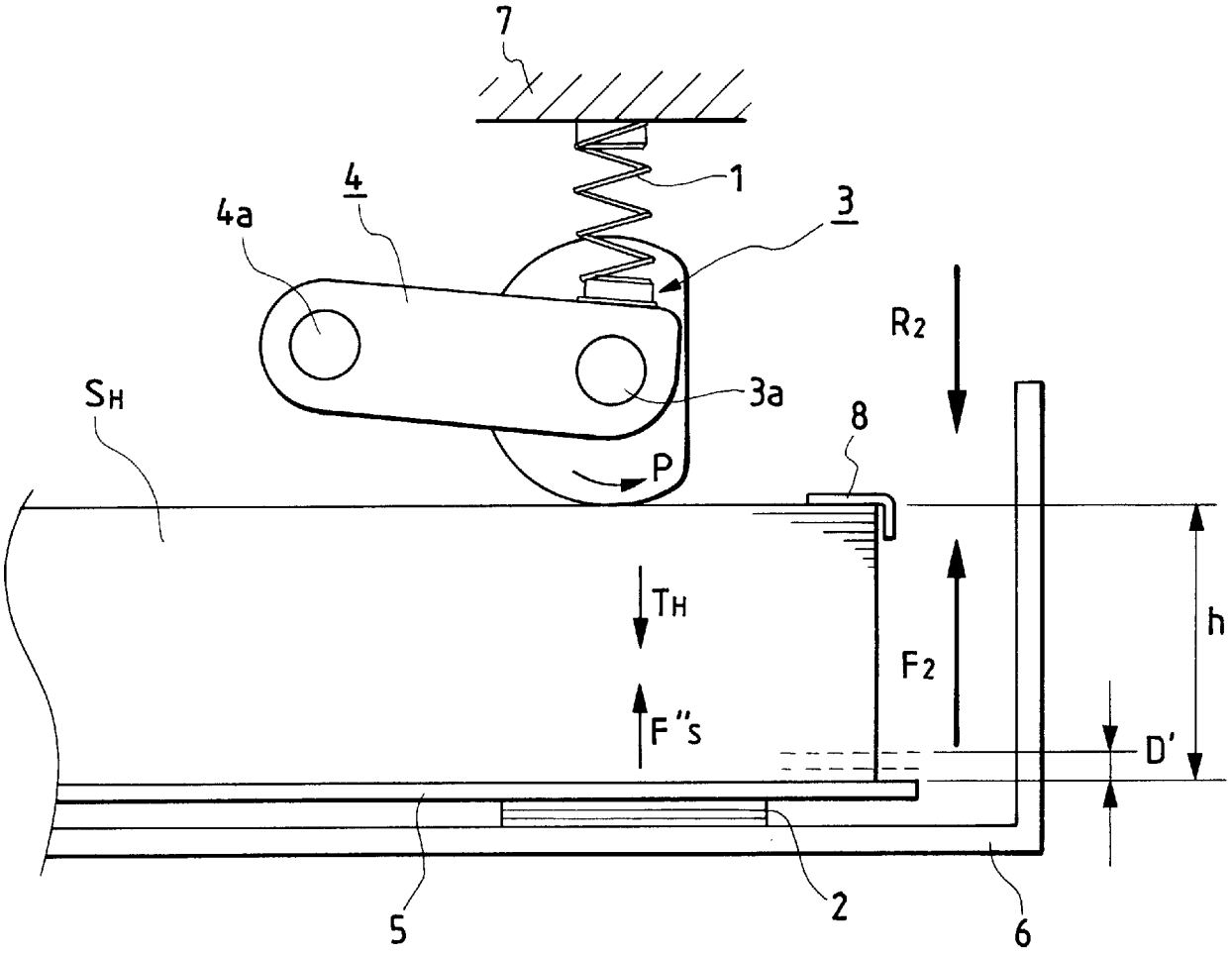
FIG. 7 is a sectional view of the pick-up portion of FIG. 1 showing an equilibrium condition when the relatively heavy sheet is picked up.

In the above-mentioned conventional arrangement, the decrease from the upward biasing force $F_0$ acting on the sheet stack S having the standard weight to the upward biasing force $F_2'$ acting on the sheet stack S having the relatively heavy weight causes the reduction of the sheet supply pressure R. To the contrary, in the arrangement according to the illustrated embodiment, as shown in FIG. 7, the sheet stacking plate 5 is balanced at a position lower than the position shown in FIG. 3 (shown by the broken line in FIG. 7) by a predetermined distance D'. In FIG. 7, when a biasing force acting on the sheet stacking plate 5 from the coil spring 2 is Fs", the gravity force of the weight of the sheet stack S comprised of the sheets having the relatively heavy weight is $T_H$, an upward biasing force acting on the sheet stack S is $F_2$, the following equation (16) is established, similar to the above-mentioned case:

$$F_2=(Fs-T_H)+n/(n+1)\times\{R_0-(Fs-T_H\} \quad (16)$$

since $Fs-T_H=F_2'$, $$F_2=F_2'+n/(n+1)\times(R_0-F_2') \quad (17)$$

Further, since n>0, $$n/(n+1)>0 \quad (18)$$

Since $(R_0-F_2')>0$, in consideration of the above relations (17) and (18), $F_2>F_2'$ is derived, and, thus, similar to the above, the change in the weight of the sheet stack S can be relieved.

Figure 9:
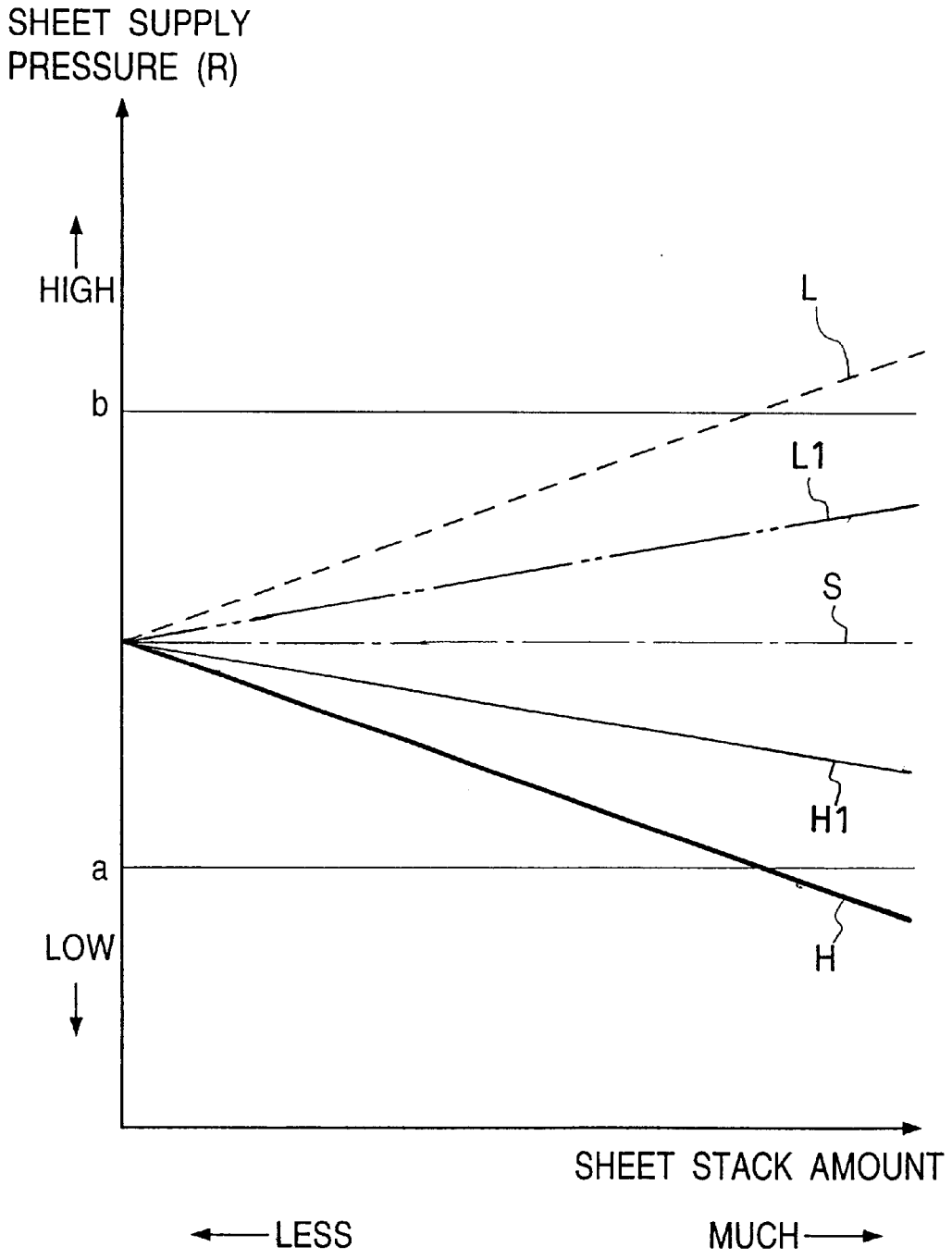
FIG. 9 is a graph showing a condition that the sheet supply pressure (R) changed in accordance with the kind of the sheet is decreased to half, according to the present invention.

FIG. 9 shows a relation between the sheet stack amount and the sheet supply pressure (R) in comparison with the conventional technique and the illustrated embodiment of the present invention, similar to FIG. 8. In FIG. 9, the abscissa indicates a sheet stack amount and the ordinate indicates the sheet supply pressure R. Further, a proper range (minimum a, maximum b) in which the normal sheet supplying operation can be effected is defined by a minimum limit a and a maximum limit b.

Similar to FIG. 8, regarding the conventional technique, the case where the sheets S having the relatively light weight are stacked is shown by the broken line L in FIG. 9 and the case where the sheets S having the relatively heavy weight are stacked is shown by the fat solid line H in FIG. 9. Further, in the arrangement according to the illustrated embodiment, the case where the sheets S having the relatively light weight are stacked is shown by the two-dot and chain line $L_1$ and the case where the sheets S having the relatively heavy weight are stacked is shown by the thin solid line $H_1$. Furthermore, the case where the sheets S having the standard weight are stacked is shown by the dot and chain line S in FIG. 9.

As shown, the broken line L and the fat solid line H exceed out of the proper sheet supply pressure range (between a and b) around the full sheet stack amount. To the contrary, in the arrangement according to the illustrated embodiment, as shown by the two-dot and chain line $L_1$ and the thin solid line $H_1$, since the change in the weight of the sheet stack S can be decreased to about a half, even when the sheets S are fully stacked on the sheet stacking plate, the sheet supply pressure R can be maintained within the proper sheet supply pressure range. Further, as shown in FIG. 2, in a case where lower surfaces 4*c* of the pick arms 4 and the flat surface portion 3*b* of the pick-up roller 3 (which act as a convey and guide means for guiding the sheet S) are used as a convey means for the sheet S on which an image was formed, as shown in FIG. 2, by stopping and holding the flat surface portion 3*b* of the pick-up roller 3 so that the flat surface portion faces to the sheet stack S, it is possible that a convey/guide surface for the sheet S can be obtained by the lower surfaces 4*c* of the pick arms 4 and the flat surface portion 3*b* of the pick-up roller 3.

In the illustrated embodiment, while an example that the biasing means is constituted by the coil springs (elastic members) 1, 2 was explained, the biasing means may be constituted by other elastic members such as torsion coil springs or may be constituted by any biasing members other than the elastic members. Further, while an example that the pick-up roller 3 is supported by the pick arms 4 so that the pick-up roller 3 is shifted by the pivotal movement of the pick arms 4 was explained, any member for supporting the pick-up roller 3 may be shifted in a vertical direction.

Next, a second embodiment of a pick-up portion of a sheet supplying apparatus according to the present invention will be explained with reference to FIG. 10.

Incidentally, the same elements as those of the first embodiment are designated by the same reference numerals and explanation thereof will be omitted.

Figure 10:
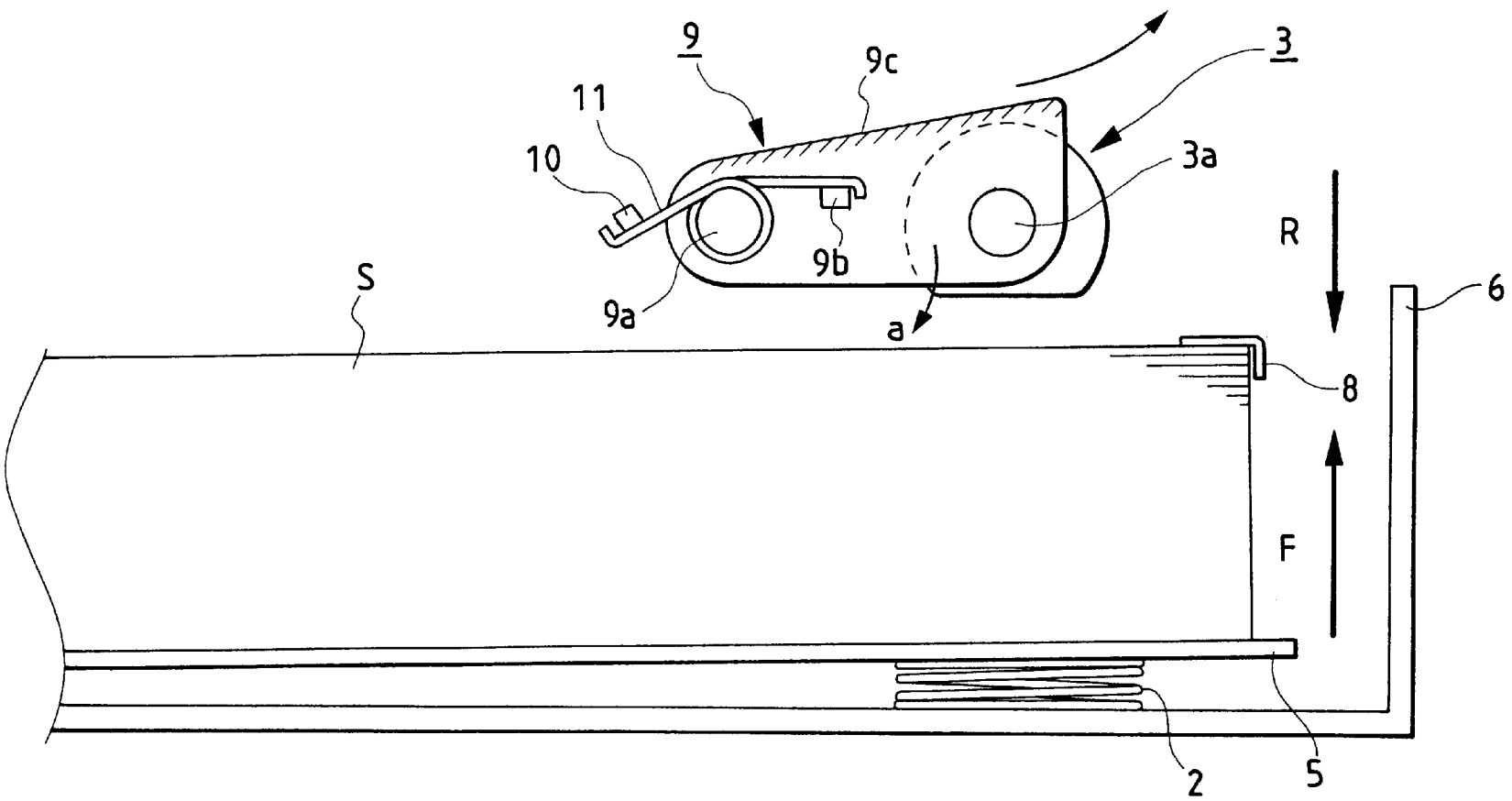
FIG. 10 is a sectional view showing a second embodiment of a pick-up portion of a sheet supplying apparatus according to the present invention.

In FIG. 10, a pick-up roller (sheet supply means) 3 is supported by pick arms 9 for rotation around a shaft 3*a*, and the pick arms are rotatably supported on a support shaft 9*a* provided on a frame of the apparatus. Torsion springs as elastic members (second biasing means) 11 are disposed on the support shaft 9*a*. Each torsion spring 11 has one end locked to a locking member 10 provided on the frame and the other end locked to a locking member 9*b* secured to the pick arm 9. By biasing the pick arms 9 by the torsion springs 11 in a direction shown by the arrow a in FIG. 10, the pick-up roller 3 are biased toward the sheet stack S.

Further, upper surfaces 9*c* of the pick arms 9 act as convey and guide surfaces for re-conveying and re-guiding the sheet S on which an image was formed in a both-face print mode or a multi print mode. The other construction of the second embodiment is the same as that of the first embodiment to achieve the same technical effect as that of the first embodiment.

Next, a third embodiment of a pick-up portion of a sheet supplying apparatus according to the present invention will be explained with reference to FIGS. 11 and 12. Incidentally, the same elements as those of the first embodiment are designated by the same reference numerals and explanation thereof will be omitted.

Figure 11:
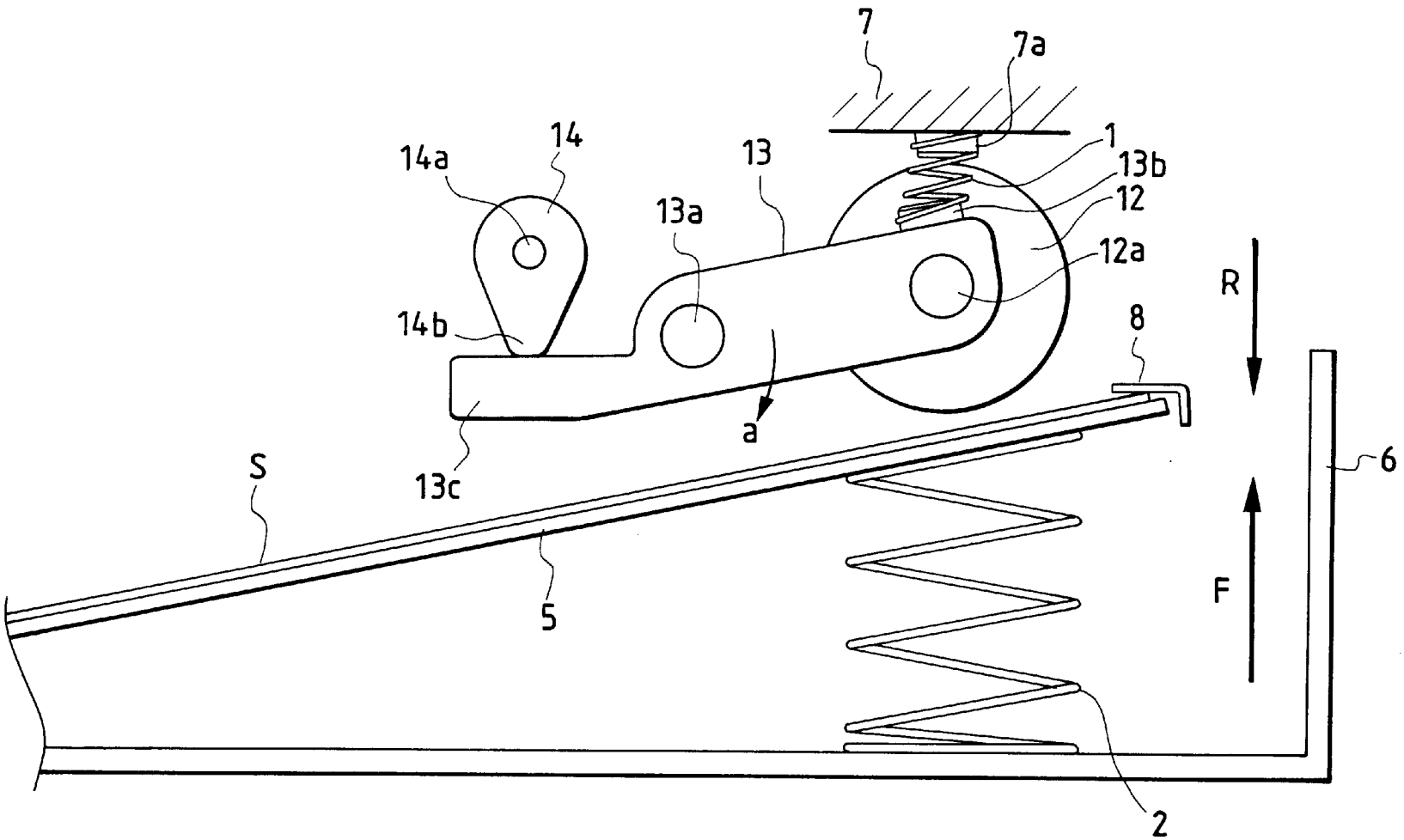
FIG. 11 is a sectional view showing a third embodiment of a pick-up portion of a sheet supplying apparatus according to the present invention.

In FIG. 11, a pick-up roller (sheet supply means) 12 is constituted by a cylindrical member supported on a shift 12*a* for rotation with respect to pick arms 13. The pick-up roller 12 is rotatingly driven by a drive system (not shown). The pick arms 13 are rotatably supported on a support shaft 13*a* provided on a frame 7 of the apparatus.

Projection portions 13*b* are formed on the respective pick arms 13 at one ends thereof immediately above the shaft 12*a* of the pick-up roller 12. Coil springs 1 as elastic members (second biasing means) are disposed between the projection portions 13*a* and projection portions 7*a* provided on the frame 7. The pick arms 13 are biased around the support shaft 13*a* toward a direction shown by the arrow a in FIG. 11 by the coil springs 1 so that the pick-up roller 12 can be urged against the sheet stack S rested on the sheet stacking plate 5.

Further, a cam abutment portion 13*c* is formed at the other end of each pick arm 13, and cams rotatably supported on a drive shaft 14*a* are opposed to the cam abutment portions 13*c*. A cam mechanism is constituted by the cams 14 and the cam abutment portions 13*c*. The revolution of the cams 14 is controlled by a sheet supply signal. When protruded portions 14*b* abut against the cam abutment portions 13*c*of the pick arms 13 by the rotation of the cams 14, the pick arms 14 are rotated around the support shaft 13*a* in a direction opposite to the direction a in opposition to the biasing force of the coil springs 1, with the result that the pick-up roller 12 is retarded from the sheet stack S. By a pick-up roller up/down mechanism comprised of the cams 14, coil springs 1 and the like, the pick-up roller 12 can be contacted with the sheet stack S and the sheet S can be biased by the pick-up roller 12 only when the sheet S should be picked up.

Figure 12:
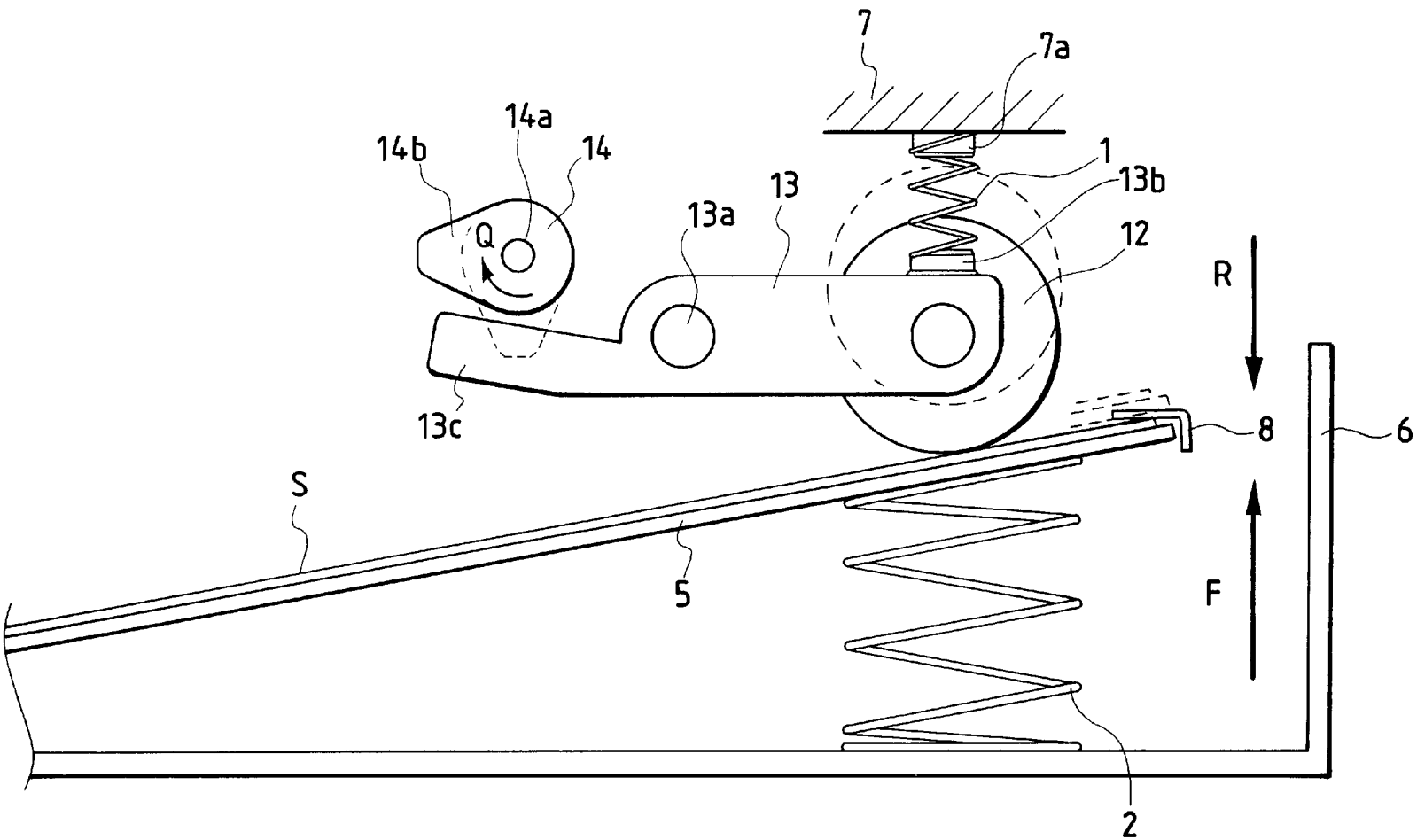
FIG. 12 is a sectional view of the pick-up portion of FIG. 11 showing a condition that the sheet is being supplied.

FIG. 11 shows a signal waiting condition, and FIG. 12 shows a condition that the sheet is being picked up. When the cams 14 are rotated in a direction shown by the arrow Q in FIG. 12 in response to the sheet supply signal, the protruded portions 14*b* of the cams 14 are retarded from the cam abutment portions 13*c*, with the result that the cam abutment portions 13*c* are rotated by the biasing force of the coil springs 1 to lower the pick-up roller 12. Consequently, the pick-up roller is balanced with the sheet stacking plate 5. In this position, the uppermost sheet S is picked up under a condition that the upward biasing force F of the coil spring 2 acting on the sheet stack S is balanced with the downward biasing force of the coil springs 1 acting on the pick-up roller 12.

The cams 14 continue to rotate by one revolution from the condition shown in FIG. 11 through the condition shown in FIG. 12 to the condition shown in FIG. 11. In this condition, the cam abutment portions 13*c* is pushed downwardly again by the protruded portions 14*b* to separate the pick-up roller 12 from the sheet stack S. In this case, while the condition shown in FIG. 12 is being returned to the condition shown in FIG. 11, the picked-up sheet S is sent to a downstream sheet convey means to continue the sheet conveyance. The other construction of the third embodiment is the same as that of the first embodiment.

As is in the first embodiment, since the sheet S is picked up by the pick-up roller 12 in the condition that the upward biasing force F of the coil spring 2 acting on the sheet stack S is balanced with the downward biasing force of the coil springs 1 acting on the pick-up roller 12, the same technical effect as that of the first embodiment can be achieved.

In this embodiment, since the pick-up roller 12 rotated around the shaft 13*a* is biased by the coil springs 1 toward a direction shown by the arrow R in FIG. 12, the operating position of the pick-up roller 12 is more stabilized than a case where pick arms for supporting a pick-up roller are suspended from coil springs, with the result that the pick-up roller 12 can be positively contacted with the sheet stack S at a constant position. Further, since the pick-up roller has the cylindrical peripheral surface (unlike to the first embodiment in which the pick-up roller has the cylindrical surface portion and the flat surface portion), the local wear of the pick-up roller can be prevented. In addition, since the orientation of the pick-up roller during the installation is not required, the replacement of the pick-up roller can be facilitated.

Next, an example of an image forming apparatus having the sheet supplying apparatus according to the present invention will be explained.

Figure 13:
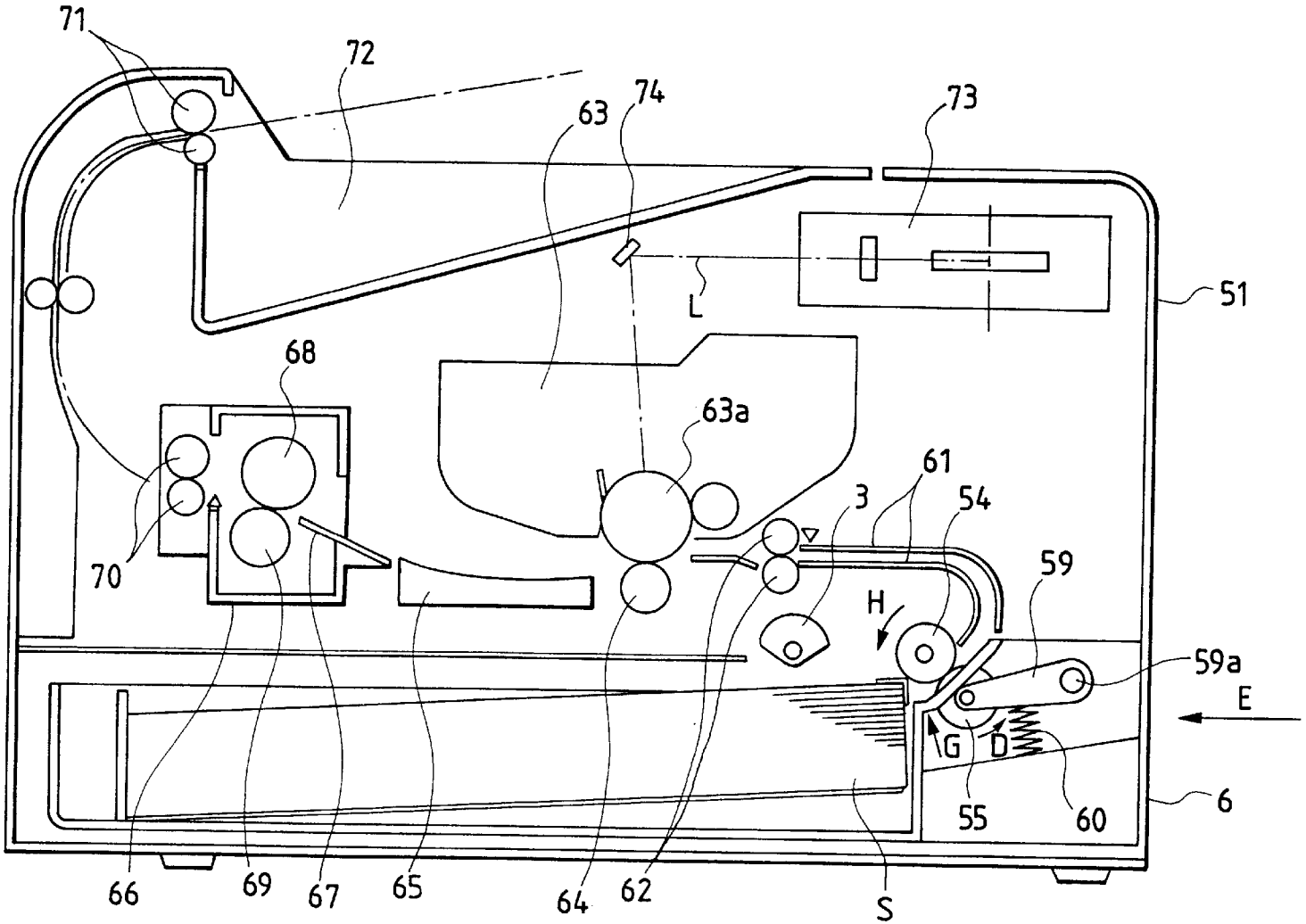
FIG. 13 is a sectional view showing an example of an image forming apparatus having the sheet supplying apparatus according to the present invention.

In FIG. 13, the reference numeral 51 denotes a body of the image forming apparatus; 3 denotes a pick-up roller constituted in the same manner as that in the above-mentioned first to third embodiments; and 54 denotes a feed roller rotated in a direction shown by the arrow H. The pick-up roller 3 and the feed roller 54 are disposed within the body 51 of the apparatus, and the feed roller 54 is disposed at a downstream side of the pick-up roller 3 in a sheet supplying direction. A retard roller 55 will be fully described later in connection with FIG. 15.

Figure 14:
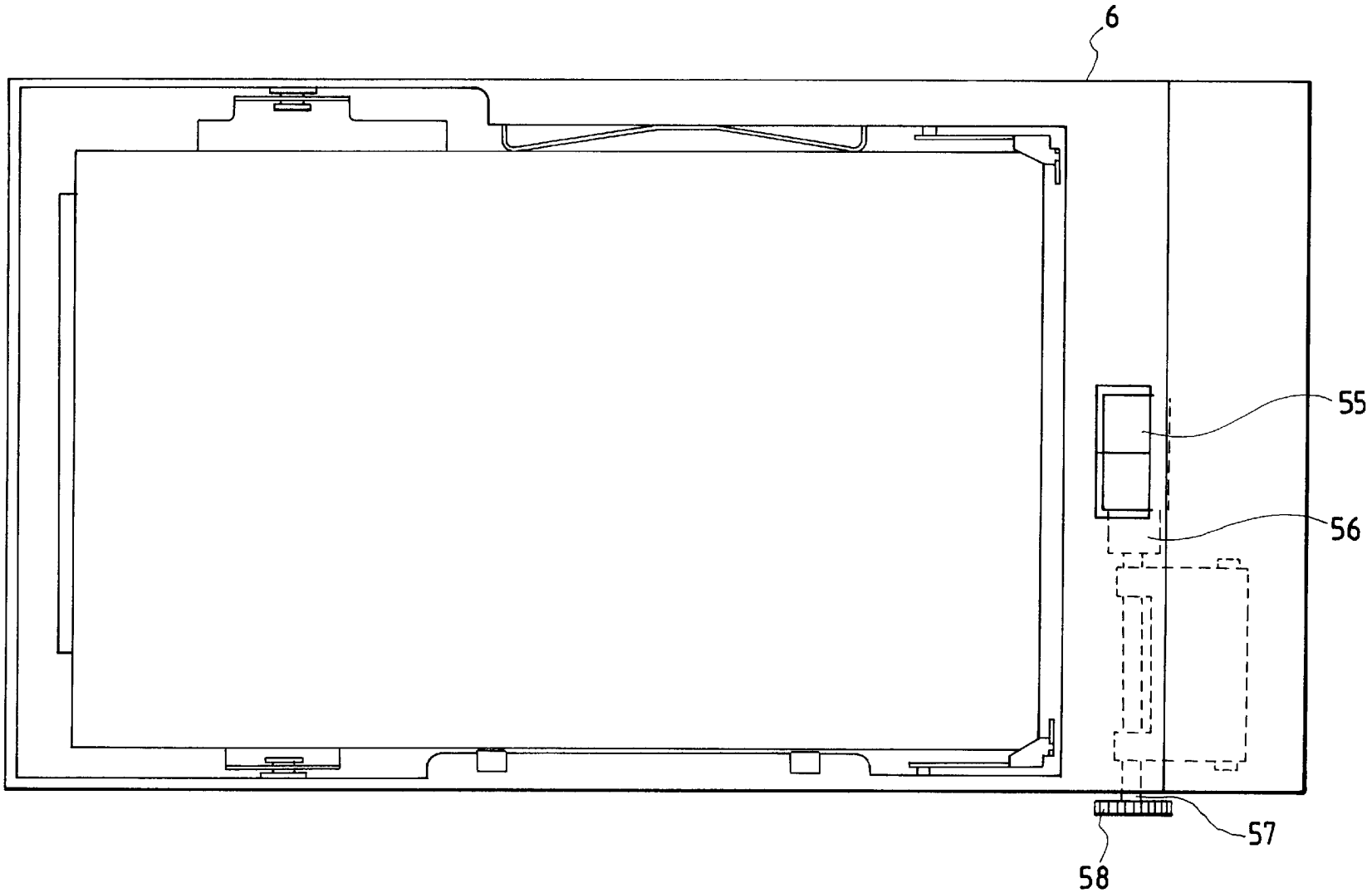
FIG. 14 is a plan view of a sheet supply cassette of the image forming apparatus of FIG. 13.
Figure 15:
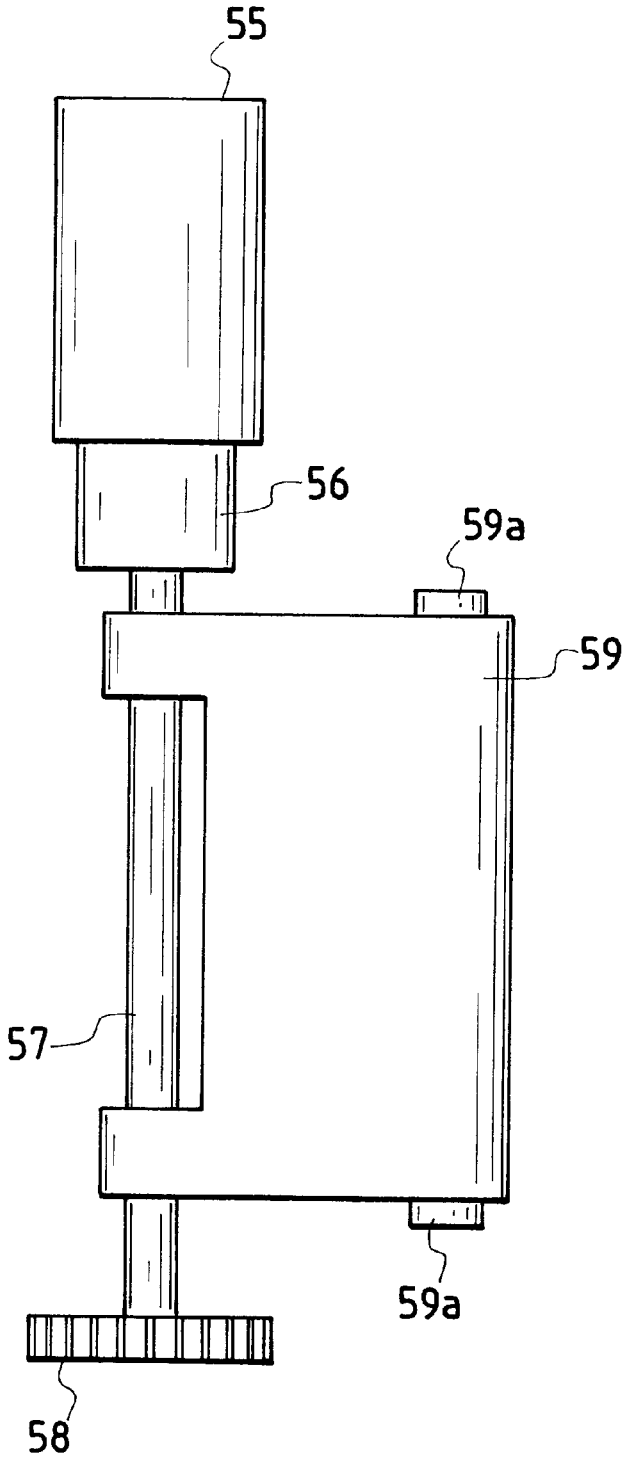
FIG. 15 is an enlarged view of a retard roller portion of the image forming apparatus of FIG. 13.

In FIG. 14, the retard roller 55 is connected to a drive shaft 57 through a torque limiter (torque control means) 56. A drive gear 58 is disposed to protrude from a sheet supply cassette 6. When the sheet supply cassette 6 is mounted within the apparatus body 51, the drive gear 58 is connected to a gear (not shown) disposed within the apparatus body 51, so that the retard roller 55 is rotated in a direction shown by the arrow D in FIG. 13. As shown in FIG. 15, a support member (support means) 59 supports the drive shaft 57 and is rotatably supported by the sheet supply cassette for pivotal movement around a support shaft 59*a*.

An elastic member (biasing means) 60 shown in FIG. 13 biases the support member 59 upwardly so that the retard roller 55 is biased toward a direction shown by the arrow G in FIG. 13. As a result, when the sheet supply cassette 6 is mounted within the apparatus body 51, the retard roller 55 is urged against the feed roller 54 with predetermined pressure. When the single sheet S is picked up by the pick-up roller 3 in the manner as mentioned above, the feed roller 54 and the retard roller 55 sent the sheet into the apparatus body 51 as it is. On the other hand, if two or more sheets S are picked up, the feed roller 54 and the retard roller 55 serve to convey the uppermost sheet S alone and to return the second and other sheets to the sheet supply cassette 6 by a return torque of the retard roller 55.

The reference numeral 61 denotes convey guides; 62 denotes convey rollers for conveying the sheet S; and 63 denotes a process cartridge (image forming means). The process cartridge 63 includes therein an electrophotographic photosensitive drum 63, a first charger (not shown), a developing device (not shown) and a cleaning device (not shown) and can be removably mounted to the apparatus body 51.

The reference numeral 64 denotes a transfer drum; 65 denotes a convey guide; 67 denotes a fixing device; 68 denotes a fixing roller; 69 denotes a pressure roller; 70 denotes fixing discharge rollers; 71 denotes discharge rollers; 72 denotes a discharge tray on which the imaged sheet is discharged; 73 denotes a scanner unit for emitting a laser beam L; and 74 denotes a mirror for directing the laser beam L to the photosensitive drum 63*a*.

With the arrangement as mentioned above, when a print command is emitted from a host computer (not shown) connected to the image forming apparatus, the pick-up roller 3 is rotated to pick up the sheet(s) from the sheet supply cassette 6. The uppermost sheet S alone is separated by the feed roller 54 and the retard roller 55. The sheet sent into the apparatus body 51 is subjected to the image forming process and then is discharged onto the discharge tray 72.

As mentioned above, by providing the retard roller 55 in association with the sheet supply cassette 6, since the elastic member 60 and the support member 59 can be provided within the sheet supply cassette 6, the entire apparatus can be made compact. Further, since a distance of a tip end of the sheet stack in the sheet supply cassette 6 and the feed roller 54 can be shortened, the dispersion in the tip end positions of the sheets can be minimized, thereby minimizing the dispersion in sheet-to-sheet distances. Further, since a nip between the feed roller 54 and the retard roller 55 can be released merely by dismounting the sheet supply cassette 6 from the apparatus body 51, the sheet jam treatment can be facilitated.

Next, another example of a feed roller 54 and a retard roller 55 will be explained.

Figure 16:
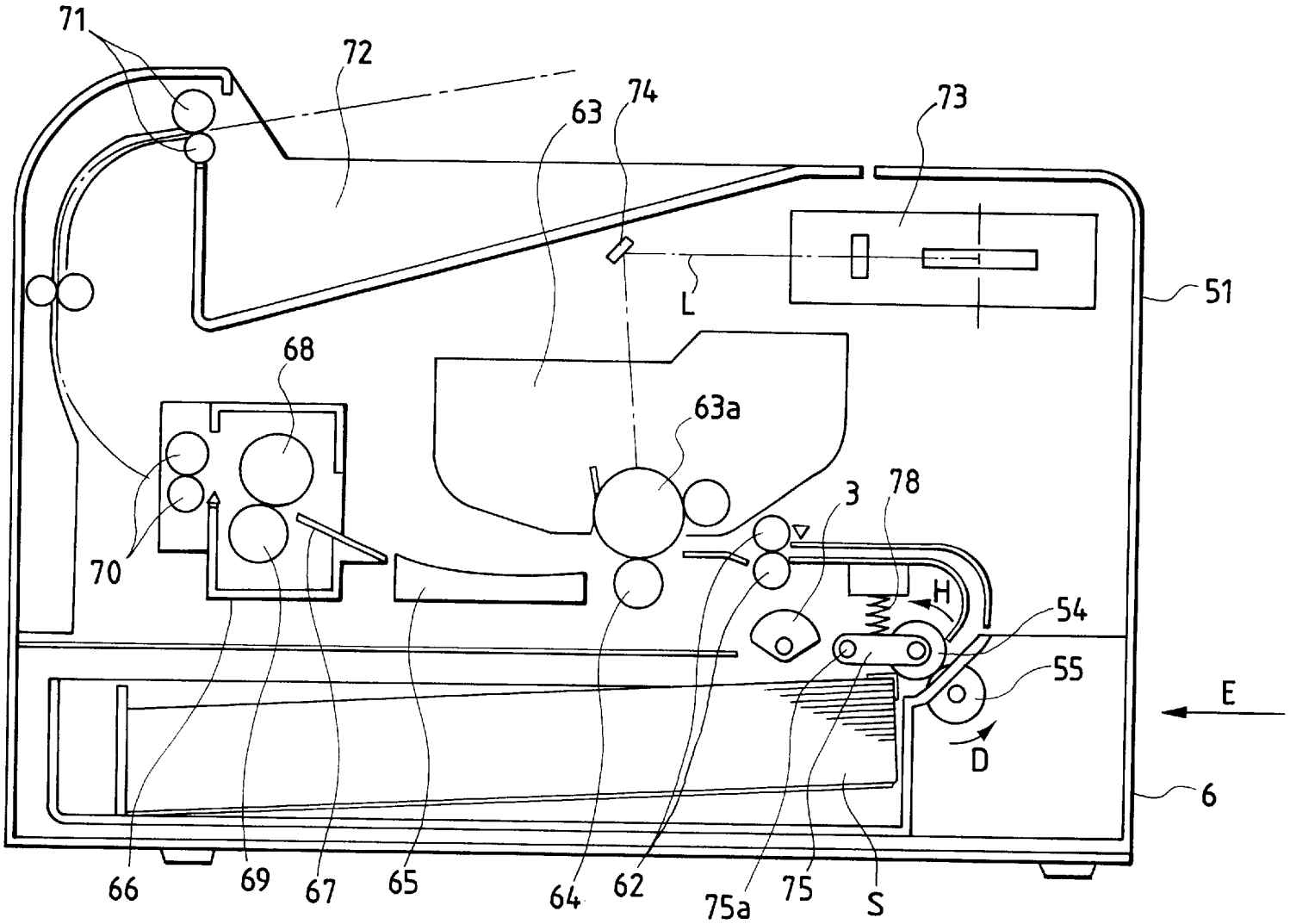
FIG. 16 is a sectional view showing a separation portion having a construction different from that shown in FIG. 13.

In FIG. 16, the feed roller 54 is rotated in a direction shown by the arrow H in FIG. 16. The torque of the retard roller 55 is controlled by a torque limiter 56. The retard roller 55 is disposed within the sheet supply cassette 6. In a condition that the sheet supply cassette 6 is mounted within the apparatus body 51, the retard roller 55 is rotated in a direction shown by the arrow D in FIG. 16.

Figure 17:
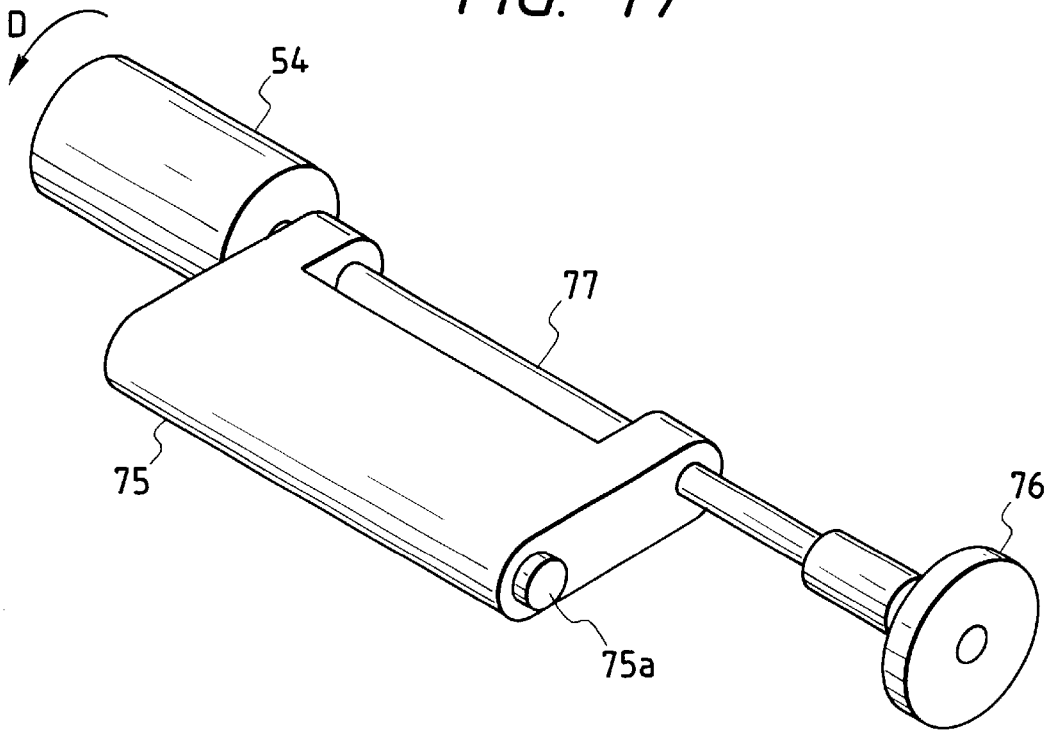
FIG. 17 is an enlarged view of a retard roller portion of FIG. 16.

A support member (support means) 75 supports the feed roller 54 and is supported on a support shaft 75*a* for pivotal movement with respect to the apparatus body 51 around the support shaft 75*a*. In FIG. 17, a gear 76 can transmit a rotational driving force to the feed roller 54 through a drive shaft 77. The gear 76 is rotatingly driven by a drive means (not shown) provided in the apparatus body 51. An elastic member (biasing means) 78 biases the support member 75 downwardly so that, when the sheet supply cassette 6 is mounted within the apparatus body 51, the feed roller 54 is urged against the retard roller 55 with predetermined pressure.

Next, another example of a support structure for the feed roller 54 will be explained.

Figure 18:
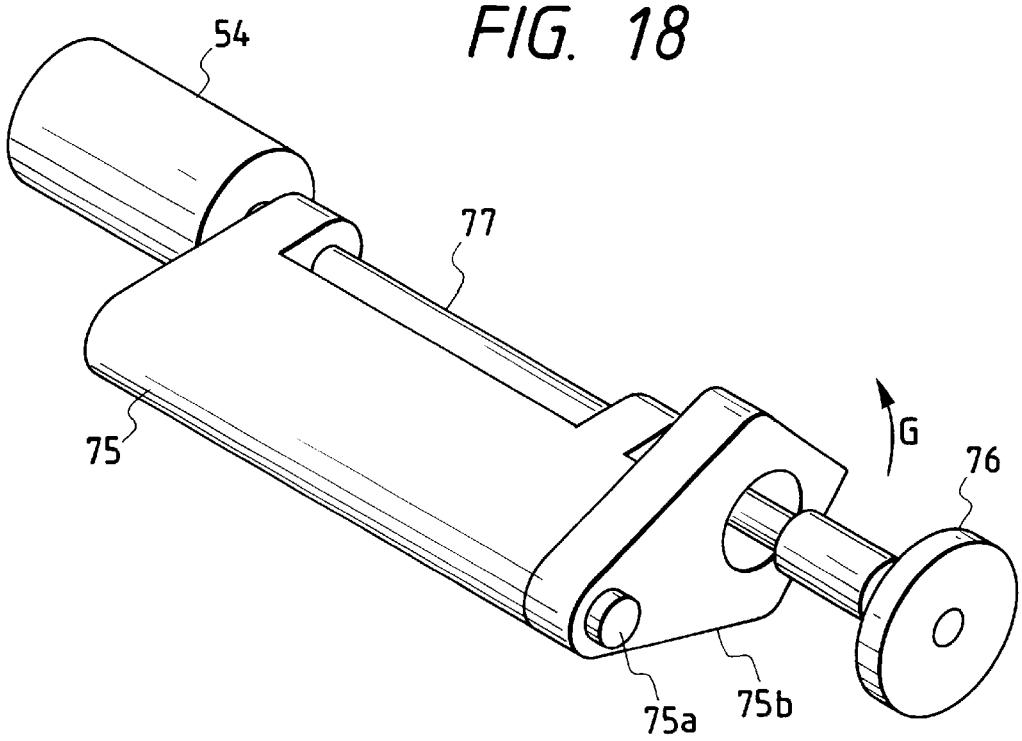
FIG. 18 is an enlarged view of a retard roller portion having a construction different from that shown in FIG. 16.
Figure 19:
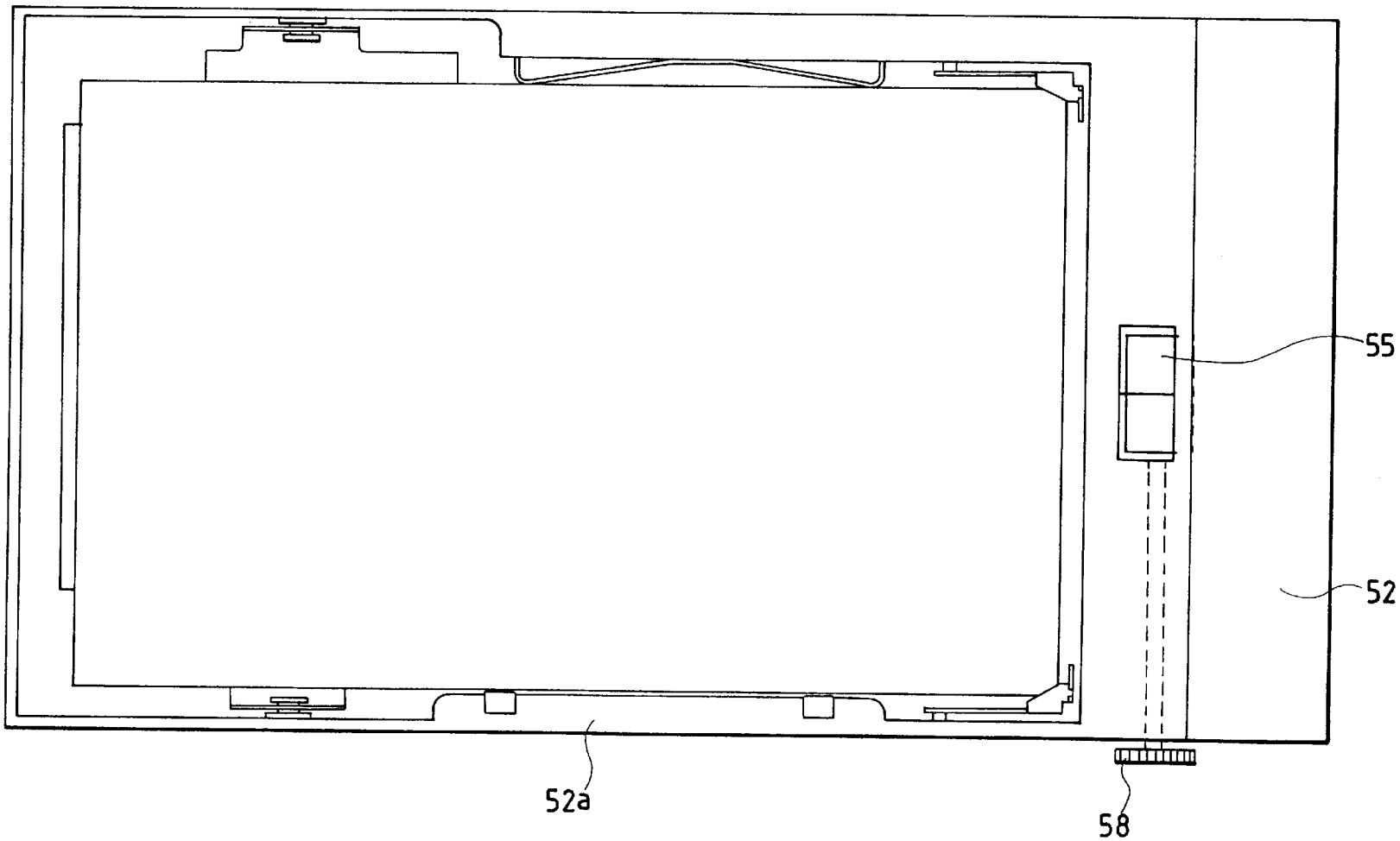
FIG. 19 is a plan view of a sheet supply cassette associated with the retard roller portion of FIG. 18.

In FIG. 18, 75 denotes a support member; 76 denotes a gear; and 77 denotes a drive shaft. The support member 75 is supported on a support shaft 75*a* for pivotal movement with respect to the apparatus body 51. The support member 75 is provided with a protruded cam surface 75*b*. When the sheet supply cassette 6 is inserted into the apparatus body 51 up to a predetermined position, as shown in FIG. 19, a cam abutment portion 52*a* formed on a side surface of the sheet supply cassette 6 abuts against the cam surface 75*b*.

With the arrangement as mentioned above, when the sheet supply cassette 6 is inserted into the apparatus body 51 up to the predetermined position, the cam surface 75*b* of the support member 75 is pushed upwardly by the cam abutment portion 52*a* of the sheet supply cassette 6, with the result that the support member 75 is rotated around the support shaft 75*a* in a direction shown by the arrow G in FIG. 18 to shift the feed roller 54 in the same direction, thereby retarding the feed roller 54. Further, when the sheet supply cassette 6 is mounted within the apparatus body 51, due to the configuration of the cam abutment portion 52*a* of the sheet supply cassette 6, the support member 75 is rotated in a direction opposite to the direction G, thereby forming a nip between the feed roller 54 and the retard roller 55.

With this arrangement, since the retard roller 55 can be provided within the sheet supply cassette, the entire apparatus can be made compact. In addition, since the feed roller 54 can be disposed near the sheet stack S, the dispersion in the sheet-to-sheet distances (sheet interval) can be minimized. Further, when the sheet supply cassette 6 is dismounted from the apparatus body, since the nip between the feed roller 54 and the retard roller 55 is released, the sheet jam treatment can be facilitated.

Figure 20:
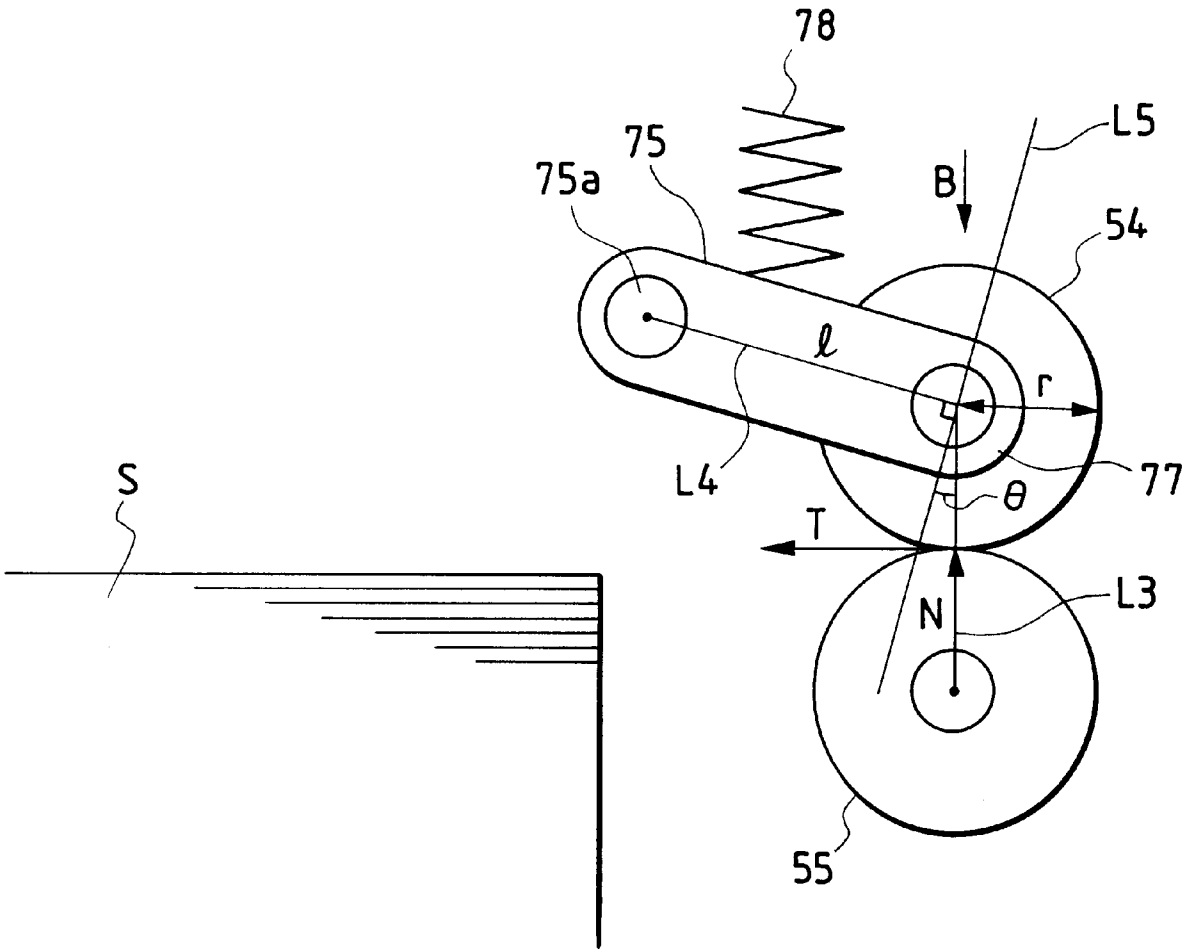
FIG. 20 is an enlarged view of the retard roller portion showing a relation between various forces.
Figure 21:
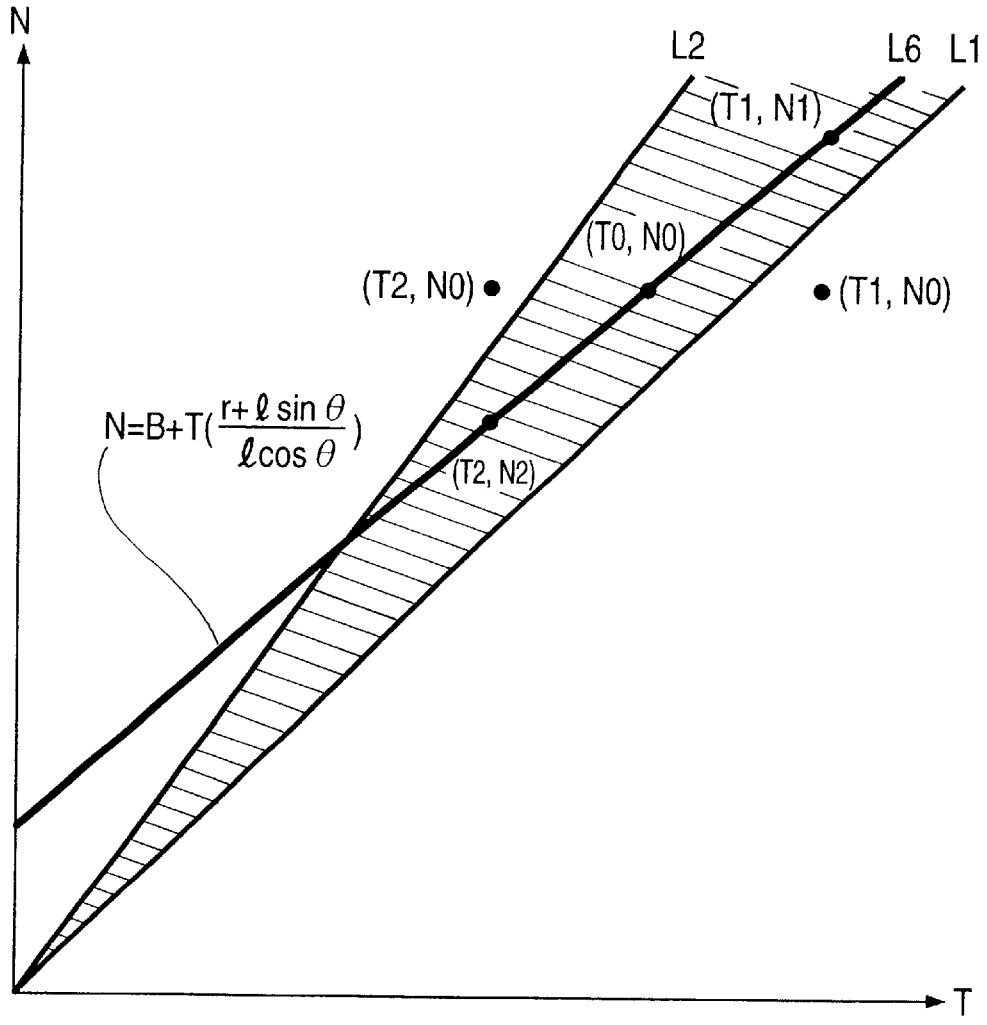
FIG. 21 is a graph showing a relation between a return torque of a retard roller and a normal force acting between the retard roller and a feed roller.
Figure 22:
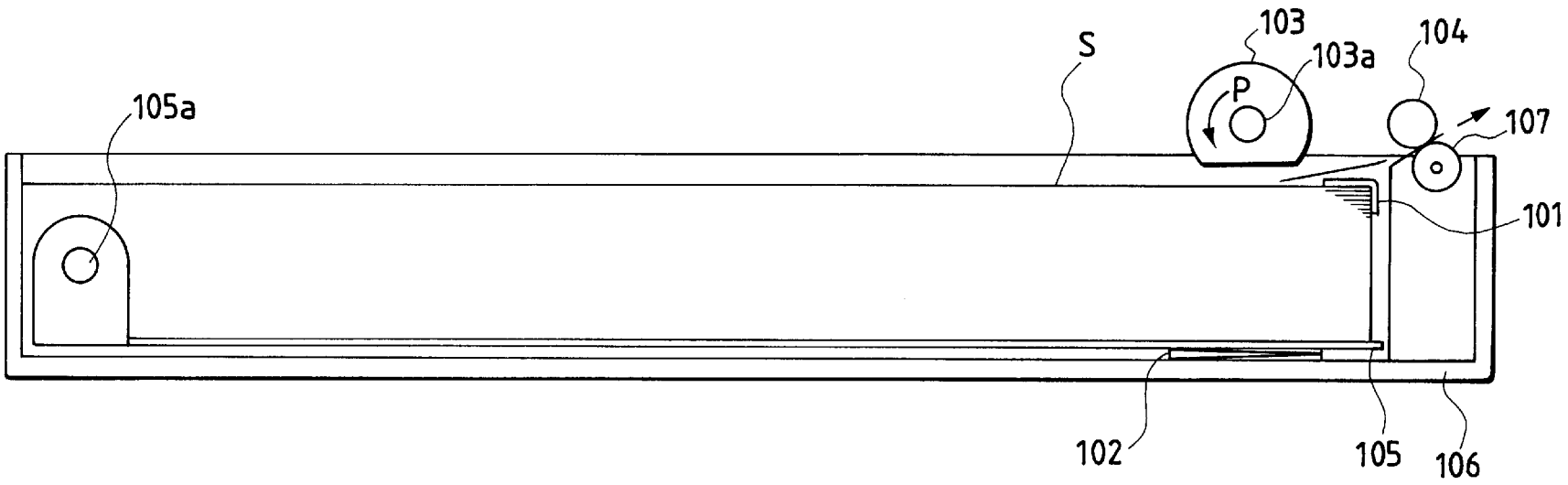
FIG. 22 PRIOR ART
FIGS. 22 to 26 are explanatory views for explaining a conventional technique.
Figure 23:
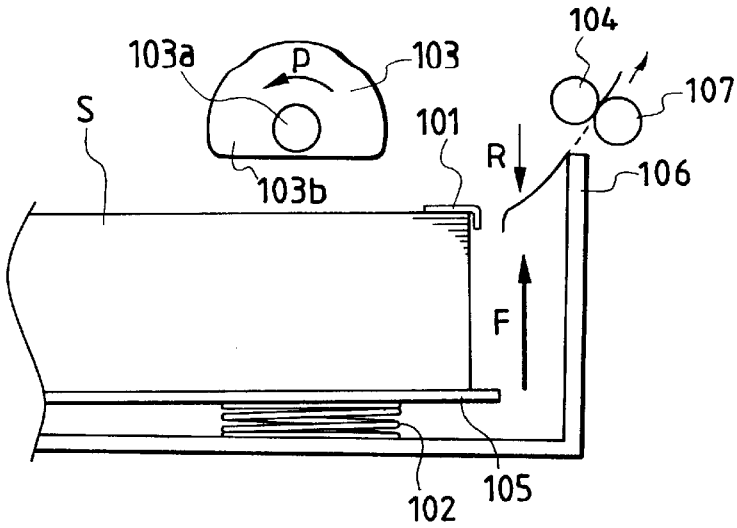
FIG. 23 PRIOR ART
Figure 24:
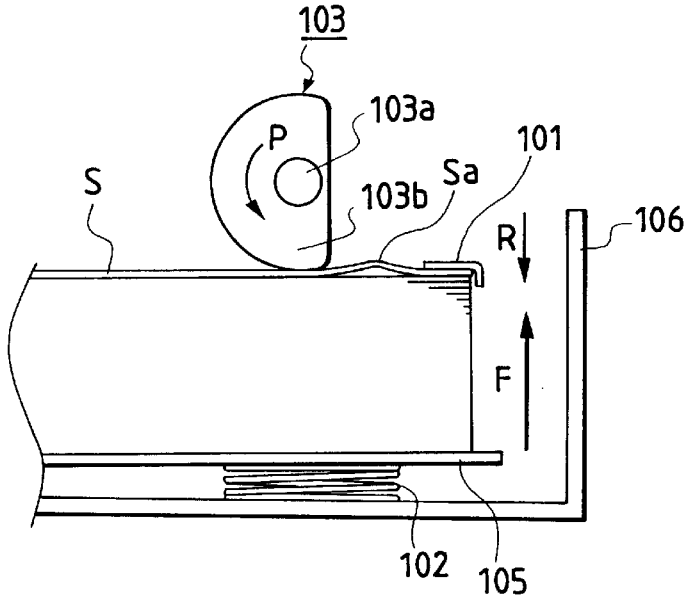
FIG. 24 PRIOR ART
Figure 25:
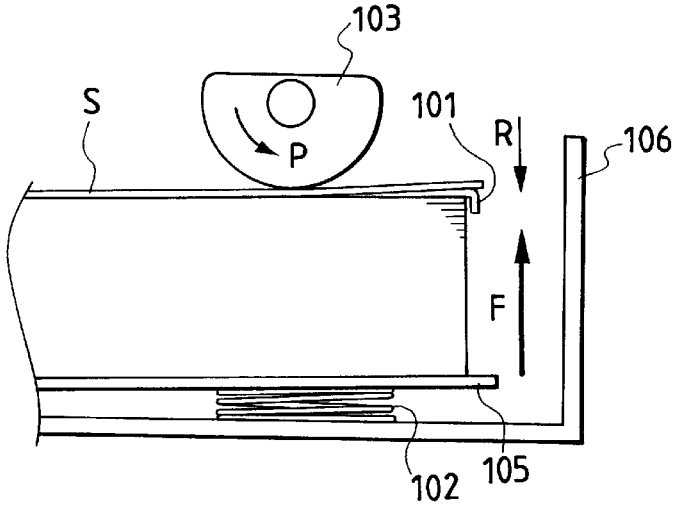
FIG. 25 PRIOR ART
Figure 26:
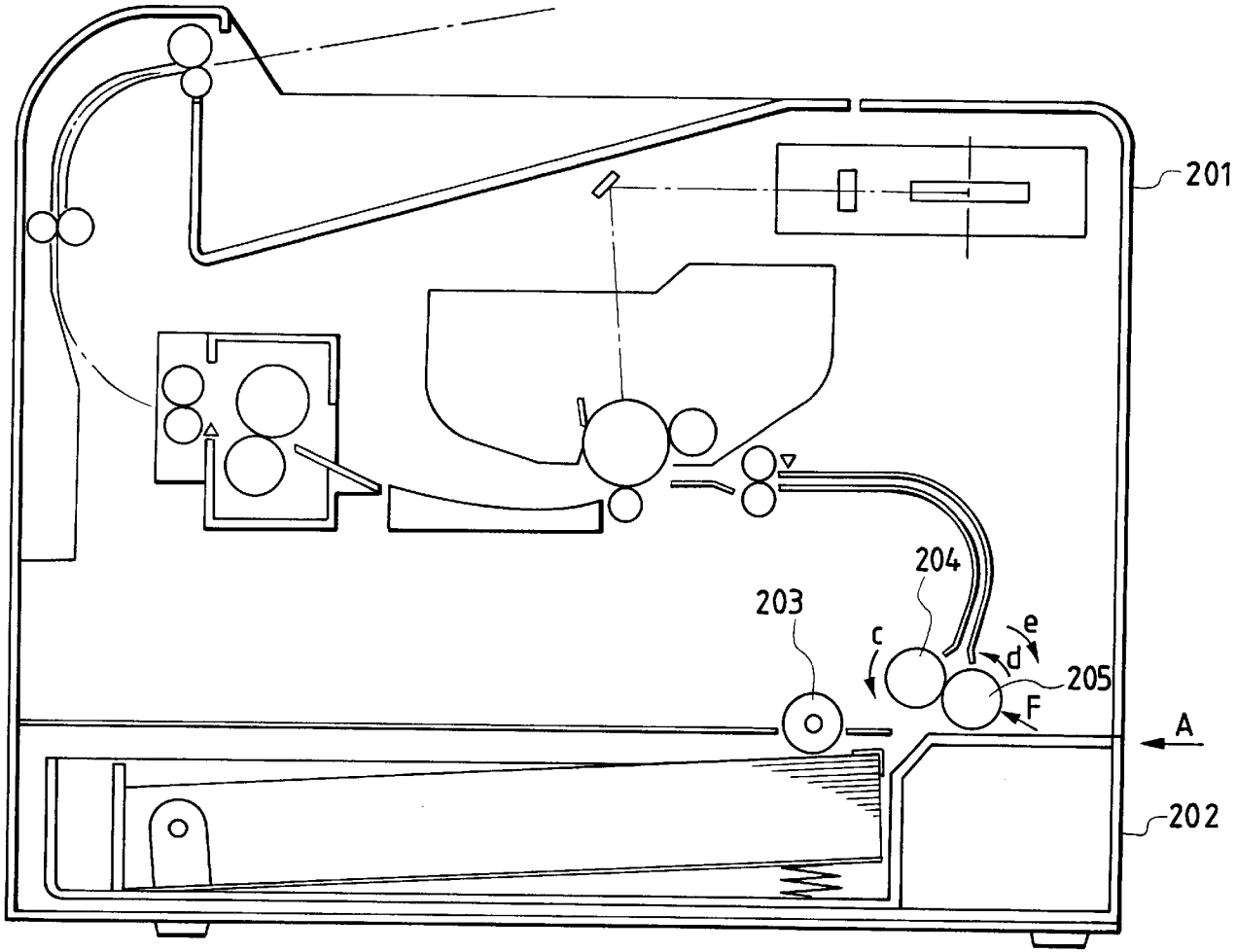
FIG. 26 PRIOR ART

Next, an excellent technical advantage obtained the specific arrangement of the feed roller 54 and the retard roller 55 will be explained. FIG. 20 is an enlarged view of a retard roller portion, and FIG. 21 is a graph showing a relation between a return torque T of the retard roller and a normal force N acting between the feed roller and the retard roller. The support member 75 is arranged so that, when the rotational driving forces are transmitted to the feed roller 54 and the retard roller 55, the feed roller is urged against the retard roller to form the nip (providing a predetermined return torque T) between the feed roller 54 and the retard roller 55.

In FIG. 20, it is assumed that a line connecting between centers of the feed roller 54 and the retard roller 55 is L3, a line connecting between a pivot center of the support member 75 and the center of the feed roller 54 is L4, a line passing through the center of the feed roller 54 and perpendicular to the line L4 is L5, a distance between the pivot center of the support member 75 and the center of the feed roller 54 is l, an angle between the lines L5 and L3 is θ, a biasing force of the elastic member 78 acting on the retard roller 55 via the feed roller 54 and directing toward the line L3 is B, a radius of the feed roller 54 is r, the return torque of the retard roller 55 is T, a normal force acting between the feed roller 54 and the retard roller 55 is N, a coefficient of friction between the feed roller 54 or the retard roller 55 and the sheet S is $\mu r$, and a coefficient of friction between the sheets S is $\mu s$.

In FIG. 20, when the rotational driving forces are transmitted to the feed roller 54 and the retard roller 55, since the return torque T of the retard roller 55 acts on the feed roller 54, the moment of (T×r) is generated around the center of the feed roller 54. Accordingly, from the balance of moments around the pivot center of the support member 75, the following relation (19) is established:

$$B\times l\cos\theta - N\times l\cos\theta + T\times(r+l\sin\theta)=0 \quad (19)$$

Seeking "N" from the above equation (19):

$$N=B+T\times\{(r+l\sin\theta)/l\cos\theta\} \quad (20)$$

From the above equation (20), it can be understood that the normal force N acting on the nip between the feed roller 54 and the retard roller 55 is proportional to the return torque T of the retard roller 55. FIG. 21 shows a line L6 representing the value of N. A hatched area between the lines L1 and L2 in FIG. 21 indicates a range in which the normal sheet separation and sheet supply can be performed. As can be seen in FIG. 21, in the illustrated embodiment, the sheet separation and sheet supply are hard to be influenced by the return torque T of the retard roller 55.

That is to say, for example, the biasing force B of the elastic member 78 and the control torque of the torque limiter 56 are selected so that the normal force N (FIG. 21) acting between the feed roller 54 and the retard roller 55 becomes N0 and the return torque of the retard roller 55 becomes T0. In this case, if the return torque of the retard roller 55 is changed to T1 or T2 due to the dispersion in operating torque of the torque limiter 56, the normal force N acting between the feed roller 54 and the retard roller 55 is changed to N1 or N2, respectively. However, in any cases, the changed normal forces are included within the hatched range in which the normal operation can be performed.

To the contrary, if there is no relation between the return torque T and the normal force N, the point (T0, N0) is shifted to points (T1, N0), (T2, N0) out of the hatched range, with the result that the normal operation cannot be performed. That is to say, when the inclination {(r+l sin θ)/l cos θ} of the line L6 (see FIG. 21) is greater than zero and smaller than ($1/\mu s$), the influence of the change in the return torque T upon the sheet separating and supplying ability can be reduced. Particularly, when the inclination of the line L6 is smaller than ($1/\mu r$) and greater than ($1/\mu s$), the influence of the change in the return torque T upon the sheet separating and supplying ability can be minimized.

More concretely, in FIG. 20, when r=12 mm, l=30 mm and θ=28°, the value N shown in the equation (20) becomes as follows:

$$N=0.98\times T+B \quad (21)$$

Now, as is in the above-mentioned conventional technique, when $\mu r$=1.0 to 2.0, $\mu s$=0.4 to 0.7, and N=280±30 gf, the return torque T is included within the hatched range shown in FIG. 21, with the result that the normal sheet separation and sheet supply can be performed.

What is claimed is:

1. A sheet supplying apparatus comprising:

a sheet supply cassette removably mounted to a main body having a sheet stacking plate for supporting sheets;

sheet supply means for feeding out an uppermost sheet by contacting with the uppermost sheet supported by said sheet supply cassette, wherein said sheet supply means contacts with the uppermost sheet supported by said sheet supply cassette and separates the uppermost sheet from the sheets;

sheet separating means for separating the sheet fed by said sheet supply means one by one, said sheet separating means having a feed roller rotating in a sheet supplying direction to supply the sheet and a retard roller rotating in a direction opposite to the sheet supplying direction, wherein said retard roller is pivotally supported by said sheet supply cassette and is biasing by a spring toward said sheet supply means;

a first spring for biasing said sheet supply cassette toward said sheet supply means;

a regulating member for maintaining the uppermost sheet of the sheets supported by said sheet supply cassette at a predetermined height against a biasing force of said first spring; and a second spring opposing said first spring for biasing said sheet supply means toward the sheets supported by said sheet supply cassette during the feeding out of sheets by said sheet supply means, wherein said sheet supply means contacts the uppermost sheet supported by said sheet supply cassette with a sheet supply pressure resulting from a balance of the biasing forces of said first and second spring and each of said first and second spring has a biasing force so that said sheet supply pressure is maintained within the proper sheet supply pressure range without regard to a weight of the sheet supported by said sheet supply cassette.

2. A sheet supplying apparatus according to claim 1, wherein said sheet stacking plate is pivotally supported by said main body, and said first spring is for biasing said plate member toward said sheet supply means.

3. A sheet supplying apparatus according to claim 2, wherein said regulating member is a separation pawl for separating the sheets one by one when the sheets supported by said sheet supply cassette are fed out by said sheet supply means.

4. A sheet supplying apparatus according to claim 1 or 2, wherein said sheet supply means is mounted on an arm member pivotally supported, and said second spring is for biasing said arm member toward the sheet supported by said sheet supply cassette.

5. A sheet supply apparatus according to claim 1, wherein said sheet supply means is a sheet supply roller having a cylindrical surface portion and a flat surface portion so that, after said cylindrical surface portion is contacted with the sheet and feeds out the sheet, said flat surface portion is opposed to the sheet to be spaced apart from the sheet.

6. A sheet supplying apparatus according to claim 1, wherein said supply means is a cylindrical sheet supply roller spaced apart from the sheet by a spacing means after the sheet is fed out by said sheet supply roller.

7. A sheet supplying apparatus according to claim 6, wherein said spacing means comprises a cam adapted to be contacted with an arm for pivotally supporting said sheet supply roller and adapted to separate said sheet supply roller from the sheet.

8. An image forming apparatus comprising:

a sheet supply cassette removably mounted to said image forming apparatus having a sheet stacking plate for supporting sheets;

sheet supply means for feeding out an uppermost sheet by contacting with the uppermost sheet supported by said sheet supply cassette, wherein said sheet supply means contacts with the uppermost sheet supported by said sheet supply cassette and separates the uppermost sheet from the sheets;

sheet separating means for separating the sheet fed by said sheet supply means one by one, said sheet separating means having a feed roller rotating in a sheet supplying direction to supply the sheet and a retard roller rotating in a direction opposite to the sheet supplying direction, wherein said retard roller is pivotally supported by said sheet supply cassette and is biased by a spring toward said sheet supply means;

a first spring for biasing said sheet supply cassette toward said sheet supply means;

a regulating member for maintaining the uppermost sheet of the sheets supported by said sheet supply cassette at a predetermined height against a biasing force of said first spring;

a second spring opposing said first spring for biasing said sheet supply means toward the sheets supported by said sheet supply cassette during the feeding out of sheets by said sheet supply means; and image forming means for forming an image on the sheet fed out by said sheet supply means;

wherein said sheet supply means contacts with the uppermost sheet supported by said sheet supply cassette with a sheet supply pressure resulting from a balance of the biasing forces of said first and second spring and each of said first and second spring has a biasing force so that said sheet supply pressure is maintained with the proper sheet supply pressure range without regard to a weight of the sheet supported by said sheet supply cassette.

9. An image forming apparatus according to claim 8, wherein said sheet supply means is pivotally supported by the image forming apparatus and is biased by a spring toward said retard roller.

* * * * *

UNITED STATES PATENT AND TRADEMARK OFFICE

CERTIFICATE OF CORRECTION

PATENT NO. : 6,328,301 B1
DATED : December 11, 2001
INVENTOR(S) : Hiromichi Tsujii et al.

It is certified that error appears in the above-identified patent and that said Letters Patent is hereby corrected as shown below:

Title page,
Item [56], FOREIGN PATENT DOCUMENTS: "U.S. PATENT DOCUMENTS" should read --FOREIGN PATENT DOCUMENTS --; and "62-47567 9/1994 (JP)" should be deleted; and "06247567 9/1994 (JP)" should read -- 6-247567 9/1994 (JP) --.
Item [56], U.S. PATENT DOCUMENTS: "5,252,854" should read -- 5,253,854 --.

FOREIGN PATENT DOCUMENTS:

| | | | |
|---|---|---|---|
| "48732 2/1989" | should read | -- 63-48432 | 2/1989 --; |
| "101537 8/1990" | should read | -- 2-101537 | 8/1990 --; |
| "166141 7/1991" | should read | -- 3-166141 | 7/1991 --; |
| "17033 1/1993" | should read | -- 5-14033 | 1/1993 --; |
| "301645 11/1993" | should read | --5-301645 | 11/1993 --; |
| "319594 12/1993" | should read | -- 5-319594 | 12/1993 --; |
| "171711 6/1994" | should read | -- 6-171771 | 6/1994 --; and |
| "166236 10/1982" | should read | -- 57-166236 | 10/1982 --. |

Column 4,
Line 40, "have" should read -- has --.
Line 50, "have" should read -- each has --; and "ends" should read -- end --.
Line 52, "are" should read -- are each --.

Column 9,
Line 66, "ends" should read -- each end --.

Column 10,
Line 14, "13cof" should read -- 13c of --.
Line 15, "arms 14" should read -- arms 13 --.
Line 42, "is pushed" should read -- are pushed --.
Line 64, "(unlike to" should read -- (unlike --.

Column 11,
Line 26, "cassette" should read -- cassette 60 --.
Line 36, "sent" should read -- send --.

UNITED STATES PATENT AND TRADEMARK OFFICE

CERTIFICATE OF CORRECTION

PATENT NO. : 6,328,301 B1
DATED : December 11, 2001
INVENTOR(S) : Hiromichi Tsujii et al.

It is certified that error appears in the above-identified patent and that said Letters Patent is hereby corrected as shown below:

Column 15,
Line 4, "supply" should read -- supplying --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,328,301 B1
DATED : December 11, 2001
INVENTOR(S) : Hiromichi Tsujii et al.

It is certified that error appears in the above-identified patent and that said Letters Patent is hereby corrected as shown below:

Title page,
Item [56], FOREIGN PATENT DOCUMENTS: "U.S. PATENT DOCUMENTS" should read -- FOREIGN PATENT DOCUMENT --; and "62-47567 9/1994(JP)" should be deleted; and "06247567 9/1994(JP)" should read -- 6-247567 9/1994(JP) --.

U.S. PATENT DOCUMENTS: "5,252,854" should read -- 5,253,854 --.
FOREIGN PATENT DOCUMENTS: "48732 2/1989" should read -- 63-48432 2/1989 --; "101537 8/1990" should read -- 2-101537 8/1990 --; "166141 7/1991" should read -- 3-166141 7/1991 --; "17033 1/1993" should read -- 5-14033 1/1993 --; "301645 11/1993" should read -- 5-301645 11/1993 --; "319594 12/1993" should read -- 5-319594 12/1993 --; "171711 6/1994" should read -- 6-171771 6/1994 --; and "166236 10/1982" should read -- 57-166236 10/1982 --.

Column 4,
Line 40, "have" should read -- has --.
Line 50, "have" should read -- each has --; and "ends" should read -- end --.
Line 52, "are' should read -- are each --.

Column 9,
Line 66, "ends" should read -- each end --.

Column 10,
Line 14, "13cof" should read -- 13c of --.
Line 15, "arms 14" should read -- arms 13 --.
Line 42, "is pushed" should read -- are pushed --.
Line 64, "(unlike to" should read -- (unlike --.

Column 11,
Line 26, "cassette" should read -- cassette 60 --.
Line 36, "sent" should read -- send --.

UNITED STATES PATENT AND TRADEMARK OFFICE

CERTIFICATE OF CORRECTION

PATENT NO. : 6,328,301 B1
DATED : December 11, 2001
INVENTOR(S) : Hiromichi Tsujii et al.

It is certified that error appears in the above-identified patent and that said Letters Patent is hereby corrected as shown below:

Column 15,
Line "supply" should read -- suppling --.

Signed and Sealed this

Twenty-fifth Day of June, 2002

*Attest:*

*Attesting Officer*

JAMES E. ROGAN
*Director of the United States Patent and Trademark Office*